US005775043A

United States Patent [19]

Muroi

[11] Patent Number: 5,775,043

[45] Date of Patent: Jul. 7, 1998

[54] UNDERGROUND CONSTRUCTION

[76] Inventor: Ko Muroi, 37-8, Kokubu-kita 3-chome, Ebina-shi, Kanagawa, 243-04, Japan

[21] Appl. No.: 258,660

[22] Filed: Jun. 10, 1994

[30] Foreign Application Priority Data

| | | | |
|---|---|---|---|
| Jun. 10, 1993 | [JP] | Japan | 5-165120 |
| Jun. 10, 1993 | [JP] | Japan | 5-165121 |
| Jun. 10, 1993 | [JP] | Japan | 5-165122 |
| Jun. 10, 1993 | [JP] | Japan | 5-165123 |
| Jun. 10, 1993 | [JP] | Japan | 5-165124 |
| Jun. 10, 1993 | [JP] | Japan | 5-165125 |
| Jun. 10, 1993 | [JP] | Japan | 5-165126 |
| May 23, 1994 | [JP] | Japan | 6-130864 |

[51] Int. Cl.[6] ..... E02D 29/00; E04H 6/00; E04F 11/00

[52] U.S. Cl. ..... 52/169.6; 52/169.7; 52/169.8; 52/169.9; 414/244

[58] Field of Search ..... 52/169.6, 169.7, 52/169.8, 169.9; 414/262, 263, 244

[56] References Cited

U.S. PATENT DOCUMENTS

| | | | |
|---|---|---|---|
| 4,078,346 | 3/1978 | Mann | 52/169.6 X |
| 4,231,201 | 11/1980 | Harnois | 52/169.6 |
| 4,637,176 | 1/1987 | Acock, Jr. | 52/169.6 X |
| 5,007,244 | 4/1991 | Muri | 52/169.6 X |
| 5,046,910 | 9/1991 | Tokuhiro et al. | 52/169.6 X |

FOREIGN PATENT DOCUMENTS

| | | | |
|---|---|---|---|
| 2681088 | 3/1993 | France | 52/169.9 |

*Primary Examiner*—Wynn E. Wood
*Attorney, Agent, or Firm*—Leighton K. Chong

[57] ABSTRACT

An underground construction has: a circumference wall forming therein a cone shaped space; plural support members located at the circumference of the cone shaped space at vertically the same height; floor construction bodies each having plural bed beams and a floor portion, the ends of the bed beams being supported by the support members, and the floor portions being disposed in the middle of the cone shaped space at a fixed interval from the circumference wall.

No pillars for supporting the floors are needed, thereby leaving a maximum clear space on the floors for use.

33 Claims, 28 Drawing Sheets

UNDERGROUND CONSTRUCTION

BACKGROUND OF THE INVENTION

1. The field of the Invention

This invention relates to an underground construction which does not need to have pillars standing on the ground. The underground construction having no pillar is made by digging directly underground from the ground surface. This underground construction can be equipped with air-conditioning facilities. Noises can be intercepted, in the underground construction, at a floor interval. A water tank can be disposed at a bottom of a cone shaped space. The underground construction can be used as an underground parking lot or a greenhouse. The underground construction can provide an underground space that is completely isolated from the ground surface. A floor construction body of the underground construction can hung by suspending means.

2. Description of Prior Art

A floor construction body is supported by several pillars standing on the ground in current buildings. Conventional underground constructions include a roof, a bed, and floor portions. Accordingly, when the number of floors increases, the weight that each pillar supports increases. The pillars have to support tremendous loads in buildings having many floors. When a building is planned or designed, calculation of the thickness or strength of the pillars becomes tedious and very complicated. In the case of buildings having underground floors, they are similar to buildings built on the ground from the structural strength view point. Weight of all floors must be supported by pillars standing on the underground supporting basis. The underground supporting basis is considered as a standard or reference level for each pillar.

A parking lot for cars is handled as a normal building too except simple parking lots. Therefore, buildings for parking lots having three floors or more are planned or designed in the very same way as for normal buildings. A strength calculation for each pillar and beam is generally similar to ones for normal buildings. A parking lot established underground is built on the same structural theory as for a parking lot built on the surface. Thus, the weight of all floors is supported by pillars standing on the underground supporting basis. When the number of floors becomes large, the ratio that pillars occupy in an elevation plan area of the buildings increases.

The effective area of the buildings decreases because of the pillars. A construction of buildings having no pillars is therefore desired.

Further, the energy that the building needs in air-conditioning becomes a social problem too. The building built on the surface exposes its four sides to fresh air. Enormous energy has to be discharged fruitlessly from the buildings. Great energy has been used for air-conditioning in summer time in proportion to an inclination of earth's warmness in recent years. The existing power generation facilities cannot supply enough electricity for consumers once in a while. The development of air-conditioning facilities for underground construction has been demanded.

The development of stairs for underground construction has been also demanded. When a building has several floors, noises can be transmitted between vertically adjacent floors. Persons living in this kind of residence or working in this kind of office are disturbed by these noises. The influence of noises occurring on the ground to an underground construction is small and an underground construction has a characteristic that can provide people with a quiet environment. Accordingly the development for intercepting noise in a floor interval has been demanded to make the best use of this characteristic.

In the underground construction of this invention, a space is provided between a circumference wall and a floor portion. When rain falls, rainwater comes into the inside of the underground construction. Accordingly, the development of handling of rainwater has been demanded.

When a pillar exists in parking lots, the number of cars capable of parking decreases even if the area for parking is the same, since cars have a limit of a minimum turn radius. The development of parking lots having no pillar has been demanded from such point of view.

A current greenhouse is usually put up on the ground. The greenhouse includes frameworks and transparent covers installed on the frameworks. The frameworks consist of pillars standing on the ground and beams supported thereby. The covers are made of transparent sheet materials such as glass, vinyl sheets etc. Furthermore, a greenhouse comprises a one story housing except ones for appreciation. Therefore, greenhouses having two floors or more rarely exist. Especially, it is usual that a greenhouse for agricultural purposes such as growing flowers, fruit, or vegetables comprises a one story building. When the greenhouse has two floors or more, sun light comes into the floors except the highest floor from the side thereof only. The quantity of this light is not enough for raising plants. Further, if the greenhouse has two floors or more, the framework must be strong and thick for the building's safety.

A greenhouse needs to be weatherproof against a typhoon or strong wind. Further, since the building cost for a greenhouse having two floors or more is comparatively expensive, this prevents the greenhouse having multi-floors from being widely used. In the recent year greenhouses for agriculture, heating by a stove has been carried out for shipping flowers, fruits or the like all the year round. Heating of this greenhouse is conducted by, for example, burning oil. Energy necessary for heating is extremely large and the price of flowers or fruit becomes high.

Furthermore, the buildings built on the ground must have various kinds of facilities, such as devices to defend against a disaster such as a typhoon, a fire or the like. Because of these, a cost of buildings built on the ground also becomes high.

Buildings built on the ground are completely powerless in case of a fire at a nuclear power plant or a nuclear war. When the ozone layer of the earth is destroyed, ultraviolet rays bring mankind illness. A living style to use the surface of the earth may have to change in the near future.

When each floor construction body is supported at the ends of bed beams, each floor construction body and each bed beam has to become large scale. Plural support members supporting each floor construction body and each bed beam are needed and improvement of this point is also demanded.

SUMMARY OF THE INVENTION

With these problems in mind, therefore, it is the primary object of the present invention to provide a basement or underground construction wherein no pillar for supporting floor construction bodies such as a roof, a bed, or a floor portion is needed. The other object of the present invention resides in providing an underground construction wherein stairs are ideally disposed. Another object of the present invention resides in providing an underground construction wherein an air-conditioning facility consuming less energy is disposed. Further object of the present invention resides in providing an underground construction wherein noise is intercepted at a floor interval. Further object of the present invention resides in providing an underground construction wherein rainwater is handled reasonably and is used effectively. Further object of the present invention resides in providing an underground construction having no pillar wherein cars can park effectively. Further object of the present invention resides in providing an underground construction wherein plural floors can be used for greenhouses or plant cultivating fields. Such a greenhouse can be built with a small budget, is sturdy against a typhoon or strong wind, is capable of enjoying enough sunlight, and needs less heating energy. Further object of the present invention resides in providing an underground construction of floor suspension type wherein a construction period is short and construction cost is decreased. Further object of the present invention resides in providing an underground construction wherein a cone shaped space therein can be selectively closed or isolated.

To achieve the above mentioned objects, an underground construction according to a first aspect of the present invention comprises: a circumference wall forming therein a space of a cone shape; a number of support members being located at a circumference of the cone shaped space at vertically the same height; each of the floor construction bodies having a number of bed beams and a floor portion, an end of each bed beam being supported by the support members, and the floor portion being arranged at the middle of the cone shaped space with a fixed interval from the circumference wall.

Plural support members are disposed at the circumference of the cone shaped space at vertically the same height. A floor construction body is supported by these support members. The underground construction according to the present invention can have several floor construction bodies. Each floor construction body is supported by the several support members which are disposed at the circumference of the cone shaped space at vertically the same height. Accordingly, each floor construction body is supported independently. Each floor construction body needs no pillar. It is enough for each support member to have structural strength for supporting the floor construction body. The floor portion that is arranged at a center position of the floor construction body is separated by a fixed interval from the circumference wall. When this interval is large, more sun light can reach to the lower floors. When the angle between a slant of the circumference wall and a horizontal line is large, the number of floors can be increased. When the angle between a slant of the circumference wall and a horizontal line is small, more sunlight can reach to the lower floors too.

In the preferred embodiment of the invention, the plural support members are divided into plural groups. The support members of each group are disposed at vertically different heights. And, the height of each group is different from each other. The floor construction body provides several floors thereby the underground construction can have a plurality of floors. When the underground construction has two floor construction bodies or more, it is preferable to dispose an elevator at the center position thereof.

In a preferred embodiment of the invention, anti-earthquake cushions are provided between support members and bed beams of the floor construction body whereby the floor construction body is protected from an earthquake.

In a preferred embodiment of the invention, the several support members are integrally fixed to the outside frame of circular ring or polygonal ring, the outside frame is horizontally arranged on top of the circumference wall. In another preferred embodiment of the invention, the outside frame is supported by support stake foundations extending into a rock board thereby the outside frame being supported horizontally on the circumference wall.

In another preferred embodiment of the invention, stairs are provided in a top-to-bottom direction along the circumference wall, the upper ends and the lower portions of stairs are connected with the ground and the floor portions of the floor construction body, respectively. It is preferable that at least two stairs are equally provided in a circumference direction. A resident can come out from the floor portion of the floor construction body to the ground by using these stairs. Stairs can be used as usual stairs or stairs for an emergency. With these stairs, a resident can easily escape from the underground construction safely.

In another preferred embodiment of the invention, an air-conditioning facility includes small cascades and several thermostats. The small cascades are disposed at several places of the circumference wall. The thermostats are provided corresponding to each of the small cascades. When a thermostat detects a temperature over the predetermined temperature, water streams in the selected small cascade or cascades. The air-conditioning is carried out by vaporization heat of the water. The underground construction is hardly influenced by temperature change of outer fresh air compared to buildings built on the ground. Accordingly, air-conditioning can be effectively carried out by only vaporization heat of water. It is preferable that many numbers of small cascades and temperature sensors are disposed whereby air-conditioning in any places of the underground construction can be controlled in detail.

In another preferred embodiment of the invention, an air-conditioning facility includes a generator, first ducts and second ducts. The first duct blows air cooled by a generator out from an upper peripheral position of each floor to the center thereof. The second duct sucks the air blown out of the first duct at a lower central position of the floor and returns the air back to the generator. The first ducts are disposed for each floor independently. First of all, air is cooled by a generator. This cooled air blows out over each floor from the upper peripheral position to the center thereof through the first ducts which are disposed for each floor independently. The air that has been blown out over the floor is returned to the generator through the second ducts which are also disposed for each floor independently. The second ducts suck the air in at a lower center position of the floor and return the air to the generator.

In another preferred embodiment of the invention, an air-conditioning facility includes a generator, a first duct, a second duct and third ducts. The first duct blows the air cooled by the generator from the upper peripheral position of the highest floor to the center thereof. The third duct sucks the air blown out of the first duct at the lower center position of each floor and blows the air from the upper peripheral position of the floor just below said floor to the center thereof.

The second duct sucks the air blown out of the third duct at the lower center position of the lowest floor and returns the air back to the generator. First of all air is cooled by the generator. This cooled air blows out over the highest floor from the upper peripheral position to the center thereof through the first duct. The third duct sucks this air at the lower center position of the highest floor and blows the air from the upper peripheral position of the floor directly below said floor to the center thereof. In this way, the air goes down from the upper floor to the lower level one by one and cools each floor by using each third duct.

The second duct sucks the air blown out of the third duct at a lower center position of the lowest floor and returns the air to the generator.

In another preferred embodiment of the invention, an air-conditioning facility includes a generator, a fourth duct, collecting mouths and connecting ducts. First of all, air is heated by the generator. This warm air is brought to the lowest floor through the fourth duct. This warm air is sucked by a collection mouth formed at the abbreviation center of a lower part of each floor construction body. This air is directed equally aloft a floor construction body thereabove through the connecting duct.

In another preferred embodiment of the invention, the underground construction comprises floors of closed type and floors of open type. The floors of closed type have closed space isolated from the outer fresh air, the closed space being defined by the floor portions of the vertically adjacent paired floor construction bodies and partitions fitted therebetween such as glass plates, outer wall plates etc. The floors of open type have an open space through which outer air can pass freely, at least one floor of open type being interposed between at least one pair of floors of closed type thereby noises are intercepted at a floor interval. The floor of open type provides area for a garden, a park, or a field, thereby noises are intercepted at a floor interval.

Persons may live or work in a closed indoor space isolated from outer fresh air which is provided in the floor of closed type. This closed space is defined by the floor portions of vertically adjacent paired floor construction bodies and the partitions such as glass plates, or outside wall boards. Noise occurring in this closed space is transmitted through the following course to the floor of closed type disposed above or under said floor.

This course is constituted by the bed beams of the floor construction body disposed above or under said floor, the support members, the circumference wall and the bed beams and the adjacent floor construction body. The sound transmitted through this course is a very small. Noise occurring in this closed space is also transmitted through air existing in the floor of open type to the floor of closed type disposed above or under said floor.

Compared to the quantity of noises transmitted through steel bed beams, it is very small or roughly zero.

In another preferred embodiment of the invention, each floor construction body has a closed space isolated from outer fresh air. The closed space is defined by the floor portions of the vertically adjacent paired floor construction bodies, partitions fitted therebetween such as glass plates, outer wall plates etc. and ceiling plates.

Persons may live or work in a closed indoor space isolated from outer fresh air which is provided on each floor construction body. This closed space is defined by the floor portions of vertically adjacent paired floor construction bodies, the partitions such as glass plates, the outside wall boards and the ceiling plates. Noise occurring in this closed space is transmitted through the following course to the floor of closed type disposed above or under said floor.

This course is constituted by the bed beams of the floor construction body, the support members, the circumference wall and the bed beams of the adjacent floor construction body. The sound transmitted through this course is very small. Noise occurring in this closed space is also transmitted through air existing between the ceiling plates of the lower floor and the floor construction body of the upper floor to the floor of closed type disposed above said floor. Compared to the quantity of noises transmitted through the steel bed beams, it is very small or roughly zero.

In another preferred embodiment of the invention, the support members supporting the bed beams of the floor construction body are offset from each other in the circumferential direction between the vertically adjacent paired floor construction bodies thereby noise transmitted through the circumference wall course becomes further reduced.

In another preferred embodiment of the invention, a water tank is disposed at the bottom position of the cone shaped space. When rain comes down, rainwater goes inside the underground construction through the space formed between the circumference wall and the floor portion. The circumference wall of the underground construction has a conical shape. Rainwater goes down along the circumference wall to the bottom of the underground construction.

Accordingly, the rain water enters into the water tank established in the bottom of the cone shaped space and is collected therein. Rainwater is never thrown away in sewage or a river. Rainwater is saved in the water tank and is utilized for various kinds of uses in an optimum fashion. Rainwater is used for example for fire extinguishing or water for air-conditioning of each floor of the underground construction.

In another preferred embodiment of the invention, the underground construction further comprises small cascades being disposed in several places of the circumference wall, several temperature sensors being provided in correspondence to each cascade, pipeworks supplying the water saved in the water tank to the small cascades which are disposed at several places. When the temperature sensor detects a temperature over a predetermined temperature, water streams in the cascades. Cooling nearby the circumference wall is carried out by vaporization heat of this water. The water is returned to the water tank thereby the temperature of the water saved therein is lowered.

In another preferred embodiment of the invention, the underground construction further comprises at least one drain hole being formed in an inclination fashion, the drain hole extending from the circumference wall to the underground. When the water level of the water tank exceeds over the safety level, the water is thrown away in the underground through the drain hole.

In another preferred embodiment of the invention, the underground construction further comprises means through which cars can move in or out of each floor construction body. The car move in/out means may comprise a car elevator piercing through plural floor construction bodies in a vertical direction, or a tunnel and plural connection passages, each connection passage diverging from the tunnel and being connected to each floor construction body in a horizontal direction, or a spiral lap passage and connection passages, each connection passage diverging from the spiral lap passage and being connected to each floor construction body in a horizontal direction.

A car may go in and out of the floor portion of each floor construction body through the car move in/out means. Movement of a car may be conducted by driving of the car or by carriers driven by another drive system. In this embodiment, the ends of the bed beams of each floor construction body are supported by the several support members which are arranged horizontally on the circumference wall. Therefore, each floor portion of the floor construction body has no pillar. Accordingly, the whole floor portion can be used as a parking territory and the number of cars capable of parking is maximized.

In a further embodiment of the invention, the floor portion of the floor construction body slopes downward slightly in a radial direction.

The underground construction further comprises at least one exhaust duct extending from the bottom thereof to ground and at least one gas sensor for detecting the concentration of gas being disposed at an appropriate position. When the gas sensor detects a concentration over a permissible limit, exhaust gas collected at the bottom of the underground construction is exhausted forcibly through the exhaust duct.

In another preferred embodiment of the invention, the underground construction for a greenhouse further comprises a ceiling construction body having beams and ceiling panels. The ends of the beams are supported by the several support members of a highest group. The ceiling panels are supported by the beams and cover over the cone shaped space. The ceiling panel is made of transparent materials and is at the same level as the ground. The floor construction bodies in this embodiment are supported by the several support members of other than the highest group and provide areas for cultivating plants which are disposed at the center of the cone shaped space and have spaces between the circumference wall and the floor portion.

The greenhouse of underground construction is defined by a circumference wall and a ceiling construction body and is isolated from the outer fresh air. Each surface of the greenhouse except the upper surface contacts with the ground and therefore the temperature of the greenhouse is kept uniform almost all the year round. With prevention of heat escape through the upper surface of the underground construction, the temperature inside the greenhouse is kept unchanged even if heat is not added.

Space is formed between the circumference wall and the plant cultivating areas so that sunlight passing through the ceiling panel comes down to the lower floor. Each floor construction body is supported independently by several support means. Since no pillar is needed for the floor construction body, the amount of the framework materials decreases. In the greenhouse of the present invention, there is no projection projecting from the ground surface and therefore it is sturdy against typhoons and strong winds. Further, even if a part of the ceiling panel breaks, the repair can be done safely and easily.

In another preferred embodiment of the invention, the underground construction for a greenhouse further comprises a water tank and pipeworks, the water tank being disposed at the bottom of the cone shaped space, the pipeworks circulating a supply of water stored in the water tank to the plant cultivating areas. When rain falls, rainwater can be saved in the water tank by taking the ceiling panel(s) off.

This water can be used by circulating it and therefore this greenhouse of the present invention is most suitable for agriculture in a dry zone.

In a further embodiment, light reflection means are established on the surface of the circumference wall, whereby sunlight is supplied more evenly to the plant cultivating area of each floor.

In another preferred embodiment of the invention, the underground construction further comprises cover members isolating the underground space from fresh air. The cover members are detachably installed on the space above the highest floor construction body. Fresh air can be introduced inwardly by removing cover members from the space. When needed, the cover members can be installed on the space above the highest floor construction body thereby the inside space of the underground construction is isolated from the outer fresh air.

In accordance with the second aspect of the present invention, an underground construction of floor suspension type comprises: a circumference wall forming therein a space of cone shape; an outside frame of a circular ring or polygonal ring being horizontally disposed on top of the circumference wall defining the cone shaped space; support means supporting the outside frame; supporting beams bridging over the cone shaped space, the ends of the supporting beams being supported by the outside frame; floor construction bodies having floor portions disposed in the middle of the cone shaped space at a fixed interval from the circumference wall; plural suspending means hanging the floor construction bodies in the cone shaped space, each of the suspending means being suspended from the supporting beam.

Each floor construction body is hung by several steel wires which are supported by several support beams. The structural strength of a floor construction body that is needed to keep each floor construction body in a plane may be small. The ends of the support beams are supported almost horizontally by the outside frame that is a circular ring or polygonal ring and disposed on the circumference wall defining the cone shaped space therein. The foundation for the underground construction is a simple and plain one that can maintain the outer frame almost horizontally.

An outside frame is supported by support means. Accordingly, foundations for the underground construction can be built extremely easily and in a short time.

Instead of several horizontal support beams, plural supporting beams extending in an inclination fashion toward the center point above the cone shaped space can be used. Each end of the plural supporting beams is secured to the base beams forming a polygon which is supported on the outside frame at predetermined positions thereof. The other ends to the plural supporting beams are fixedly secured to each other at the center point above the cone shaped space. A frame unit of triangular shape is constituted with adjacent paired support beams and a base beam. Several frame units are put together so that a frame work of polyhedron shape is constituted.

A frame work of polyhedron shape has a large structural strength against a downward load. In comparison with a support beam in a horizontal plane, a support beam with a small section coefficient can be used. Anti-earthquake cushions may be provided between the outside frame and each of the supporting beams thereby the floor construction body is protected from shaking of an earthquake.

The support means may be support stake foundations extending into a rock board such that the outside frame is horizontally supported on top of the circumference wall.

The foundation for the underground construction is only the embedding of the support stake foundations and therefore the period for constructing the foundations is short. The floor construction body is hung by several steel wires.

The suspending means hanging the lower floor construction body passes through the upper floor construction body and supports said construction body. Bed beams for supporting each floor construction body of small size can be used thereby cost for the materials is reduced.

No support members for each floor construction body are necessary. The building process of the underground construction and the period therefor is shortened and the building cost becomes low.

In a preferred embodiment of the floor suspension type underground construction, plural support members are divided into plural groups and the support members of each group are located at the circumference of the cone shaped space at vertically the same heights. The height of each group is different from each other. The floor construction body is hung by plural suspension means at the center portion thereof and is supported by the support members at its ends.

In accordance with a third aspect of the present invention, a floor construction body comprises plural bed beams and a floor portion supported thereby, with a fixed length of each floor beam projecting from an end surface of the floor portion.

Since the fixed length of each floor beam projects from the end surface of the floor portion, when the floor construction body bridges over a cone shaped space and ends of each bed beams are supported by the plural support members which are located at the circumference of the cone shaped space at vertically the same height, a fixed length of space is provided between a circumference wall and the end surface of the floor portion. Sun light can be supplied to the lower floor construction body by this space. Outer fresh air goes in and out freely through this space. An air circulation system can be used jointly.

In accordance with a fourth aspect of the present invention, support members located at the circumference of the cone shaped space at vertically the same height comprise support means and horizontal movement restraint means, the support means supporting end portions of bed beams of a floor construction body, and the horizontal movement restraint means preventing the bed beams from moving in a horizontal direction.

The floor construction body is supported at several places along the circumference wall by support members. The floor construction body is surrounded wholly by the circumference wall. The end points of the bed beams are restrained from moving horizontally by the horizontal movement restraint means. Therefore, the floor construction body does not fall off the circumference wall.

In accordance with a fifth aspect of the present invention, a circumference wall defining a cone shaped space comprises a number of support members for supporting bed beams of a floor construction body located at the circumference of the cone shaped space at vertically the same height.

The circumference wall defining the cone shaped space has several support members at the same vertical height. The floor construction body is supported at several places by the circumference wall. The floor construction body is supported almost horizontally with this arrangement.

DETAILED DESCRIPTION OF THE PREFERRED EMBODIMENTS

Figure 1:
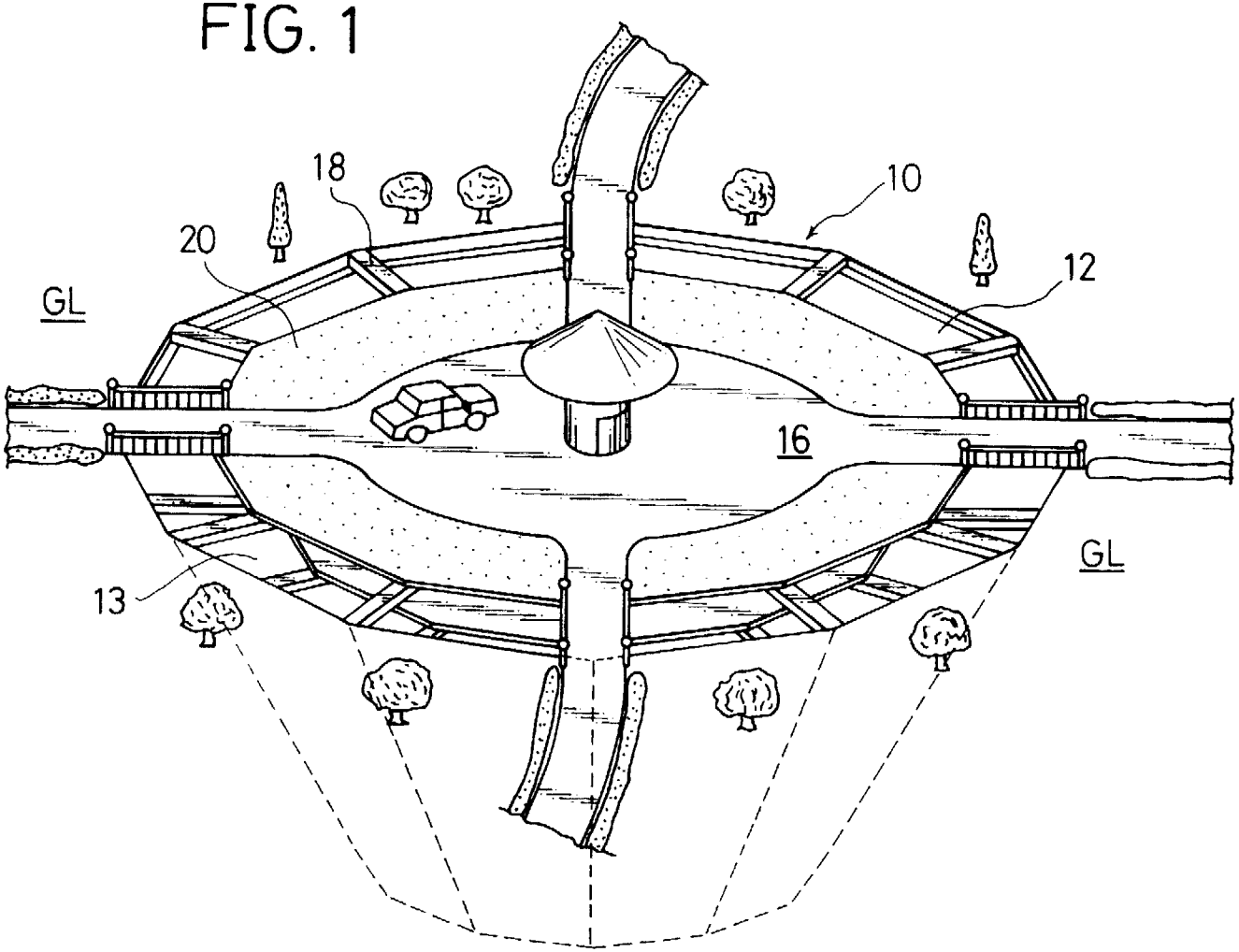
FIG. 1 is a perspective view of a first embodiment of an underground construction in accordance with the present invention.
Figure 2:
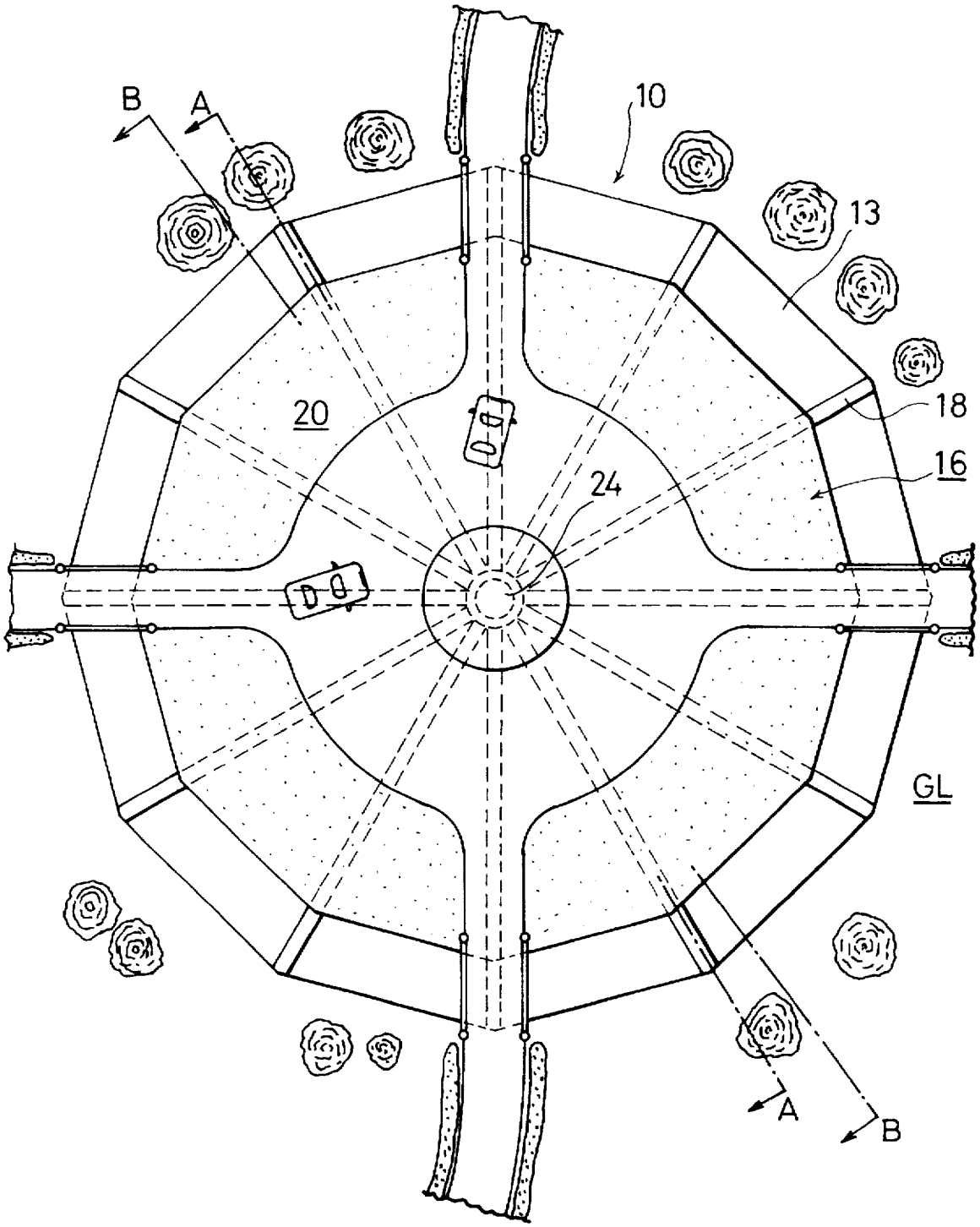
FIG. 2 is a plan view of the underground construction as shown in FIG. 1.
Figure 3:
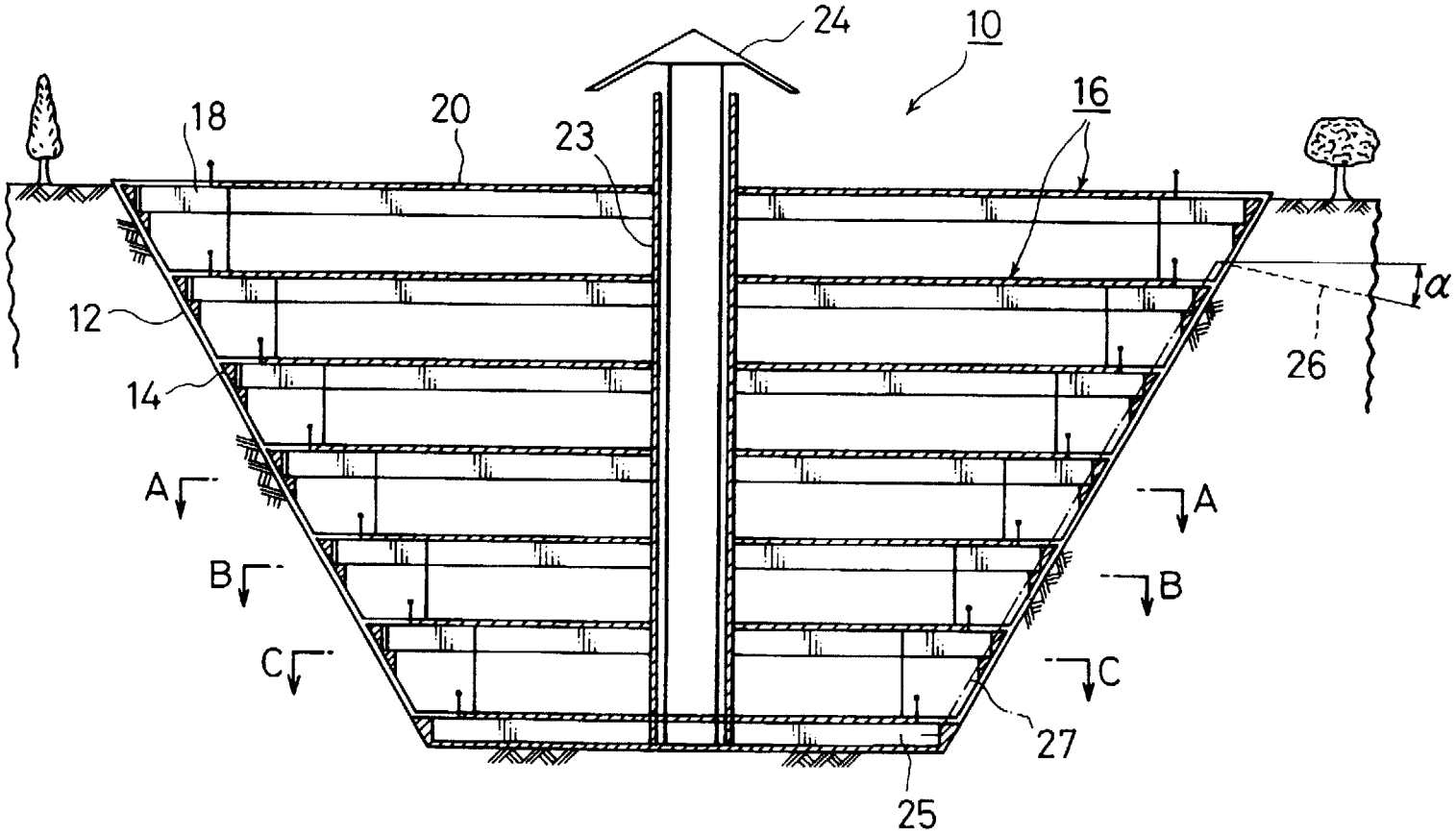
FIG. 3 is a vertical section view of the underground construction as shown in FIG. 1.
Figure 4A:
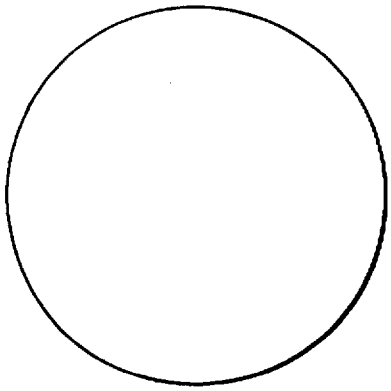
FIG. 4 (*a*)–(*d*) are plan views showing plan configurations of other embodiments of the underground constructions, respectively.
Figure 4B:
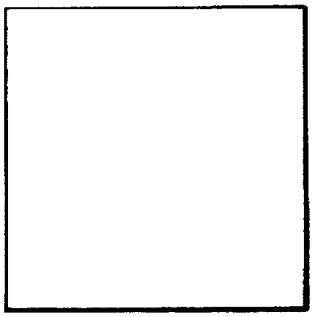
Figure 4C:
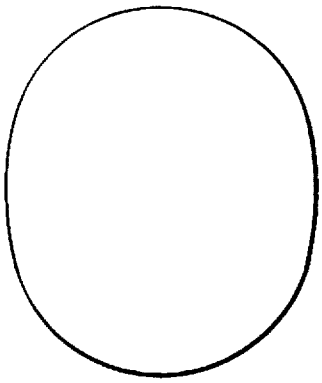
Figure 4D:
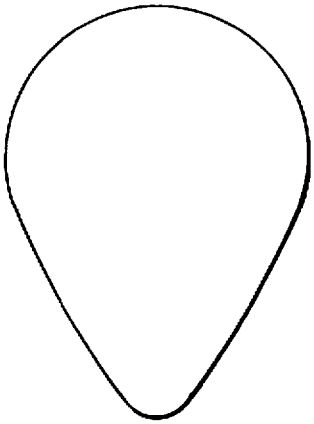

Embodiments of the underground construction according to the present invention will be described herein below in detail with reference to the attached drawings. FIGS. 1–3 are perspective view, plan view and vertical section view of an embodiment of the underground construction according to the present invention, respectively. The underground construction 10 according to this invention generally consists of a circumference wall 12 defining a cone shaped space therein, plural support members 14 that are disposed at the circumference wall 12 at vertically the same height, and a plurality of floor construction bodies 16 each supported by several support members 14. In the drawings, GL represents the ground.

The size of the underground construction 10 is a diameter of about 40 m at the ground GL, and the depth being approximately 20 m. In the preferred embodiment shown in the Figures, the underground construction 10 has 6 floors. Without being limited to this, the underground construction 10 can have, of course, any number of floors. The height of each floor may be equal or different from each other. The use in each stratum and manner of separation is voluntary.

As best shown in FIG. 3, a circumference wall 12 is formed by digging into the ground GL downwardly. The shape may be a cone or any polygonal pyramid (referred to as "cone" in this specification). The angle between the circumference wall 12 and a horizontal line is voluntary. When this angle is large, the number of floor can be increased. When this angle is small, the quantity of sunlight which can reach the lower floor is increased. The plan elevation shape of the circumference wall 12 can be a regular triangle or other shape. FIGS. 4(*a*)–(*d*) show various kinds of plan shapes of the underground constructions such as a circle, a square shape, an oval shape and drop of water shape.

A vertical section of the circumference wall 12 can take various kinds of shapes. FIG. 2 shows a straight inclined slant of the circumference wall 12 made of a concrete surface. The vertical section shape of the circumference wall 12 can also be any kind of curve. Trees or flowers can be planted on the surfaces of the circumference wall 12 when it has a step like configuration. The floor construction body 16 is constituted by the radially spreading bed beams 18 and the floor plates 20 supported on the bed beams 18. The floor plate 20 becomes a roof of the underground construction at the top floor layer.

At the underground floor 1, the underground floor 2 - - - , the floor plate 20 provides a floor surface of the BF1, BF2 - - - . In the illustrated embodiment, the floor plate 20 serves as a bed side of each floor and a ceiling of the lower floor. Of course, separate members can be used as a bed side of each floor and a ceiling of the lower floor. A space of fixed interval is formed between the circumference wall 12 and the outer circumference edge of the floor plate 20 in each floor.

Figure 5:
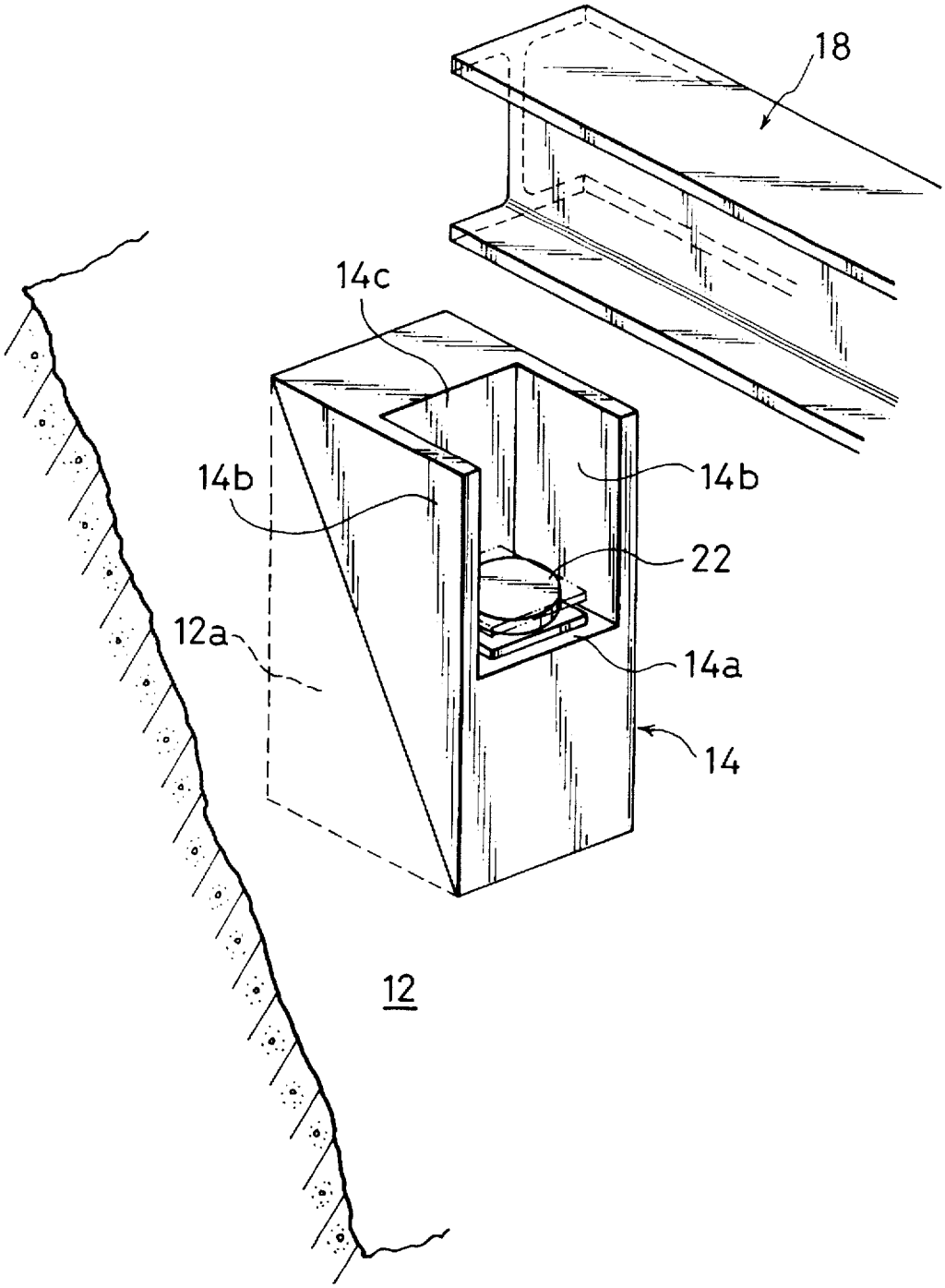
FIG. 5 is an enlarged perspective view of a support member which supports an end of a bed beam.

When this space is large, more sun light can be supplied to the lower floor. FIG. 5 is a perspective view of the support member 14 which supports the end of the bed beam 18. Support members 14 consists of a horizontal surface 14*a* that supports the lower side of the end of the bed beam 18 and a pair of perpendicular sides 14*b*, 14*b* which prevent the bed beam 18 from dropping off the support member 14.

The abutting surface 14*c* interposed between the perpendicular sides 14*b*, 14*b* provides a surface against which the end surface of the bed beam 18 abuts. With this construction, the bed beam 18 and the floor construction body 16 is prevented from moving in an elongate direction freely. In the illustrated preferred embodiment, the anti-earthquake cushion 22 is interposed between the bed beam 18 and the floor construction body 16 thereby the floor construction body 16 is protected from the shaking of an earthquake.

Support members 14 are fixed by various ways to the circumference wall 12. The support members are disposed at vertically the same height and at equal intervals in a circumference direction. In the illustrated preferred embodiment, the recess 12*a* for the support members 14 is formed with the circumference wall 12. Support members 14 are fitted in this recess 12*a*. Both are fixed by well-known means.

Figure 16:
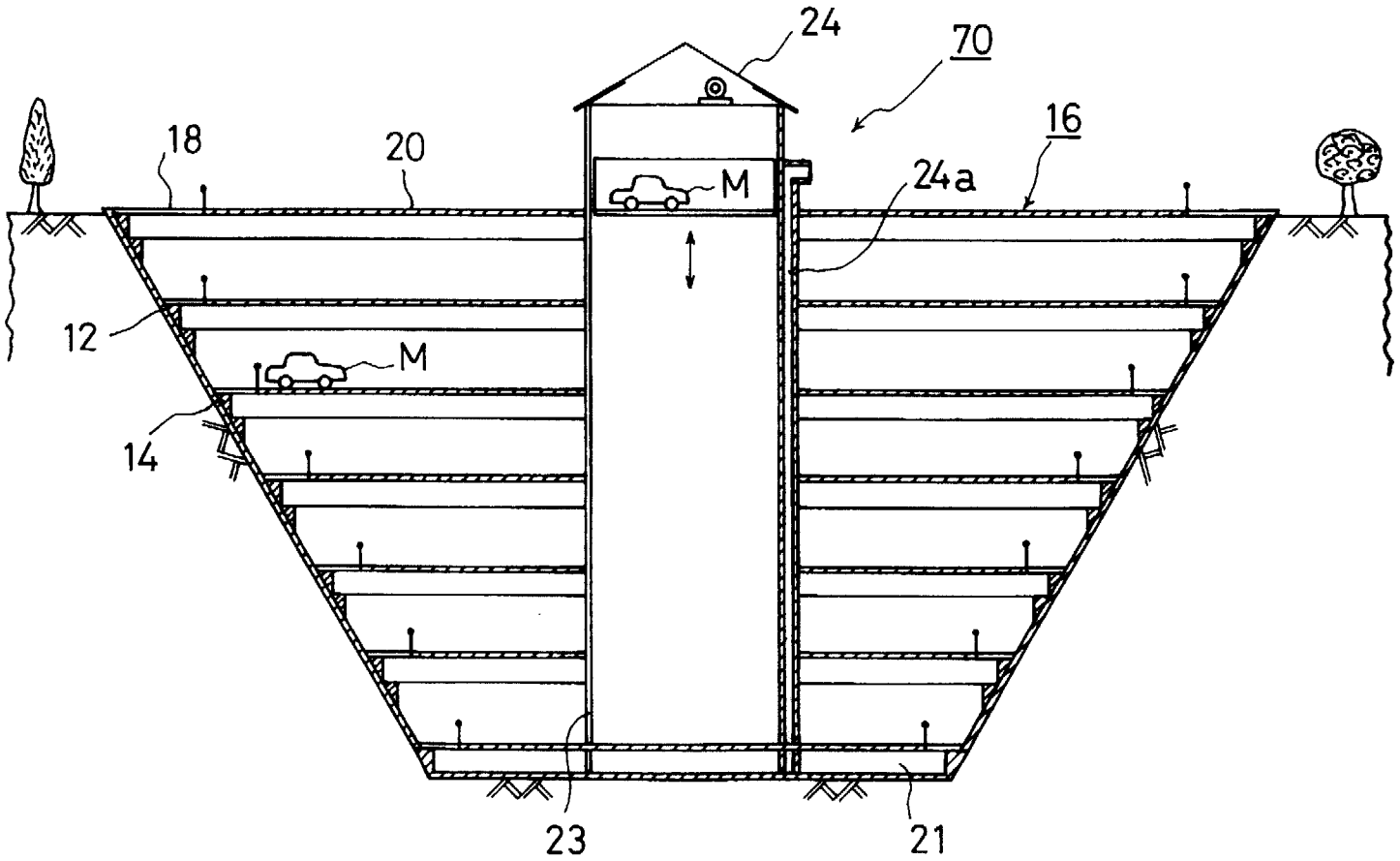
FIG. 16 is a vertical section view showing the underground construction for parking lots in accordance with the present invention.

A main feature of the present invention resides in the point that each floor construction body 16 is supported by plural support members 14 which are disposed at the circumference wall 12 at vertically the same height. With this construction, no pillar is needed for each floor construction body, fundamentally. However, an auxiliary support can be provided at the center position of the underground construction 10 as illustrated in the drawings. When the floor construction body 16 is of large scale, the auxiliary support is very useful. In the illustrated preferred embodiment, the underground construction 10 includes an elevator assembly 24 at the center position thereof (FIG. 16). Pillars 23 are disposed around the elevator assembly 24 and the pillars 23 support the center portion of the floor construction body 16 for each floor. The underground construction 10 according to the present invention has its use space in the underground and therefore it can enjoy the characteristic that it is hardly influenced by an outer temperature change. The temperature in the summer becomes higher year by year because of a trend in earth's warming. Since the underground construction is hardly influenced by the outer temperature, the energy necessary for air-conditioning can be greatly decreased. On the other hand, the underground construction is heated by the earth.

Accordingly, the energy necessary for warming can also be decreased. Furthermore, the surface of the earth side of the underground construction can be utilized for an exercise ground, a park, a parking lot etc. The underground construction is isolated from noises from the outer world. Accordingly, the underground construction may be suitable for public facility such as a hospital, a library, a school etc.

Figure 6:
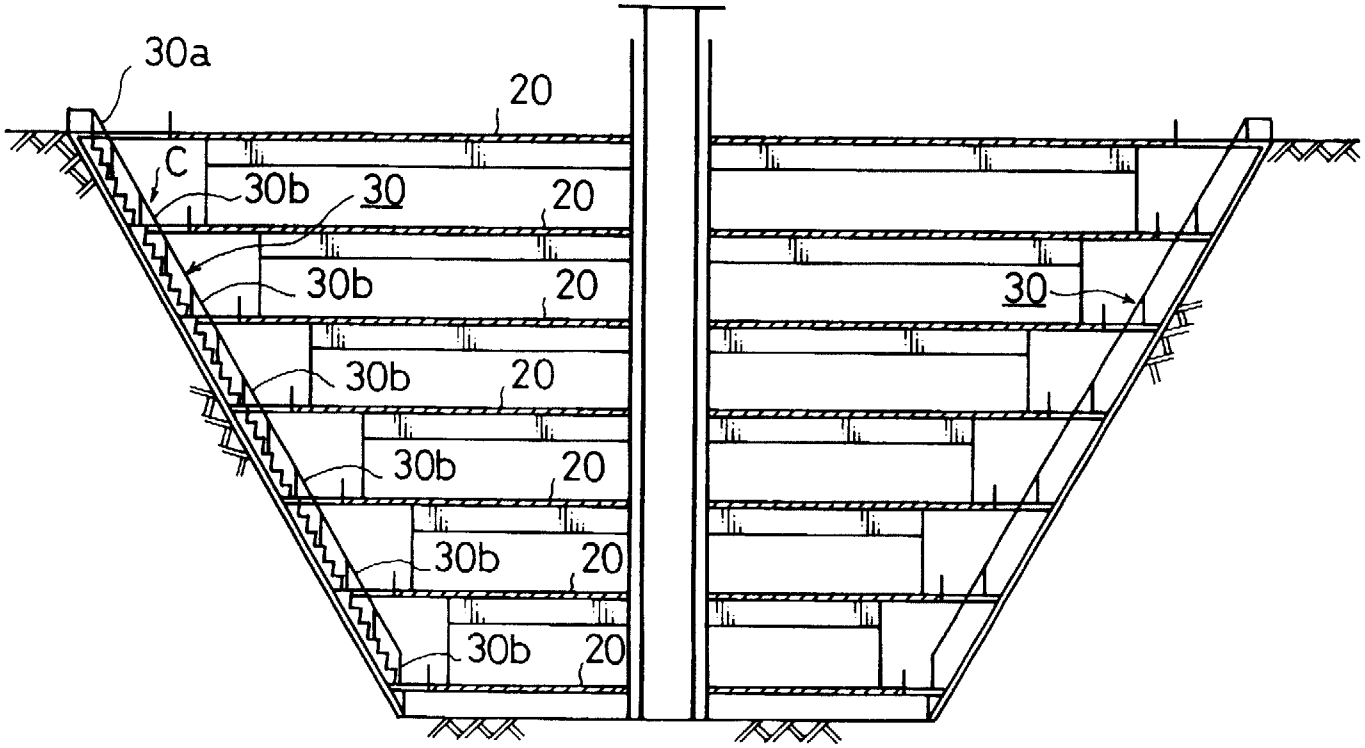
FIG. 6 is a section view of the underground construction taken along the line B—B in FIG. 2.

FIG. 6 is a cross section view taken along line B—B in FIG. 3. Stairs 30 are disposed on the circumference wall 12 of underground construction 10.

Figure 7:
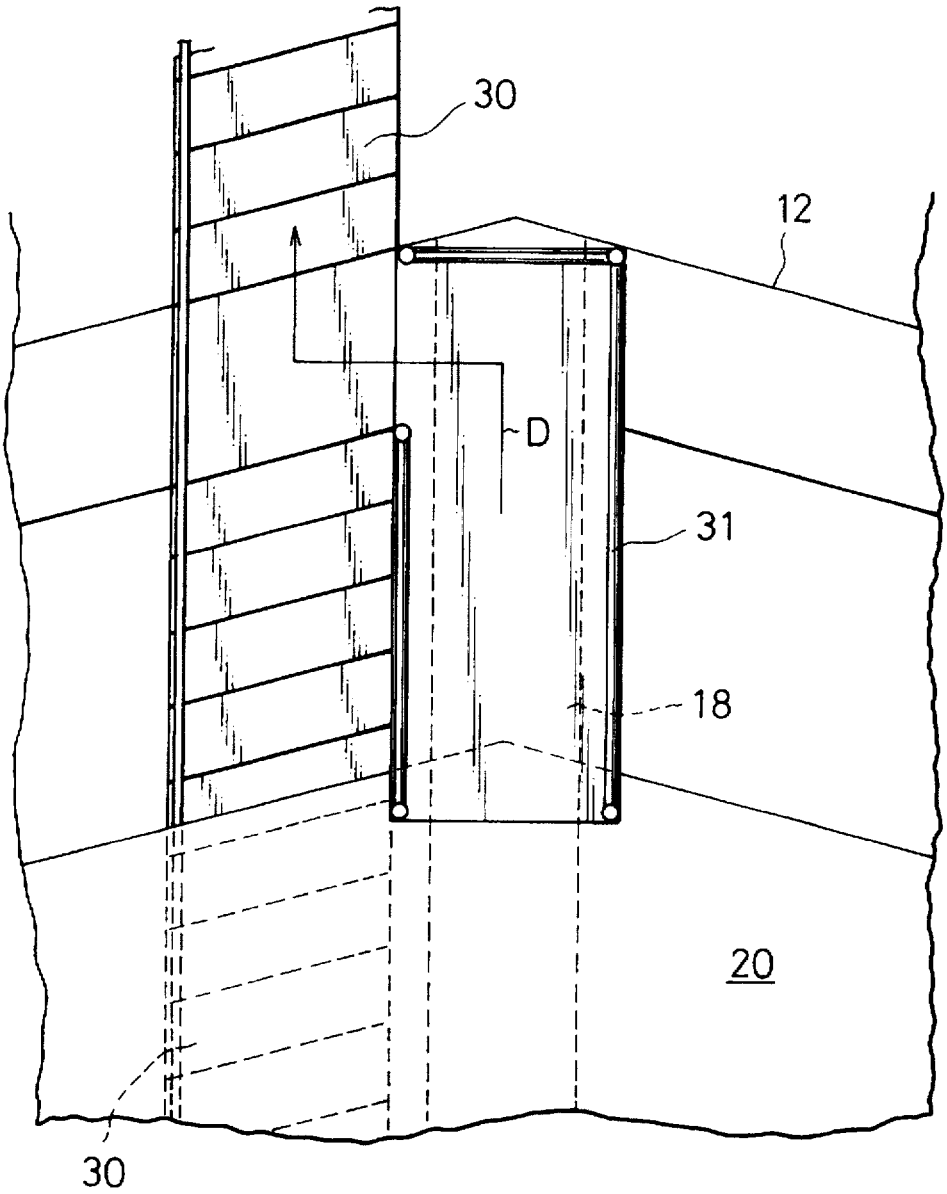
FIG. 7 is a partial plan view of the underground construction.

FIG. 7 is a partial plan view of the underground construction looking in the direction C.

Figure 8:
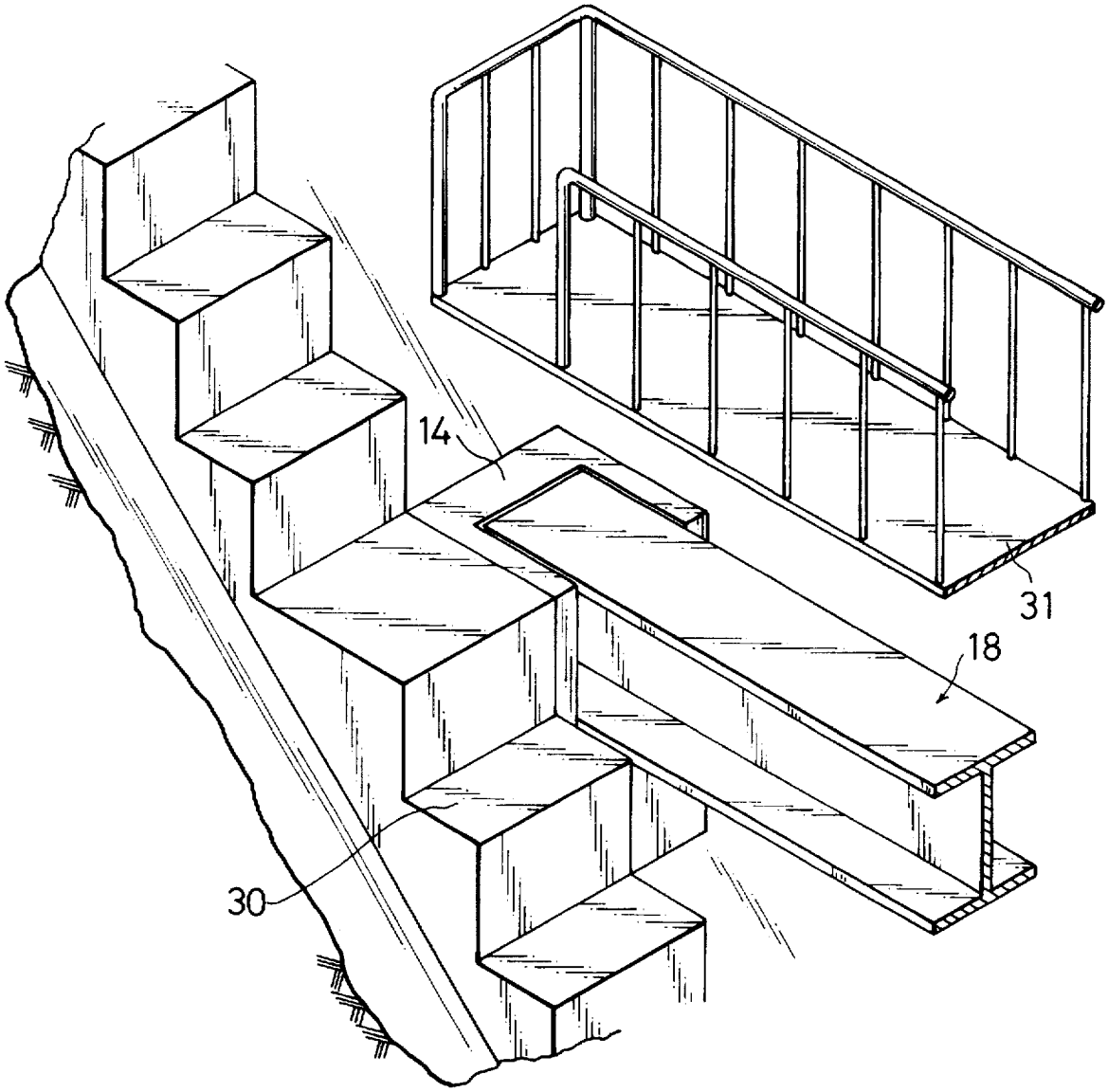
FIG. 8 is a perspective view of a connecting plate for connecting a floor or plate and stairs.

As shown in FIGS. 6 and 7, the circumference wall 12 of the underground construction 10 has stairs 30 in a top-bottom direction. The upper portion 30*a* of the stairs 30 leads to the ground GL and the lower portion 30*b* thereof has a connecting plate 31 (FIG. 8). By this connecting plate 31, the stairs 30 is connected with each floor plate 20 of the floor construction body 16.

The connection between any two of the floor plates 20 and the connection between the floor plate 20 and the ground LG is carried out by the stairs 30. The person who is on the floor plate 20 of each floor can move to the upper or lower floor through the connection plate 31 and the stairs 30, as shown by the arrow D in FIG. 7.

The person can also go out from the floor plates 20 of the floor construction body 16 to the ground GL. Stairs 30 can be used for a fire escape too. The floor plate 20 of each floor and the ground GL are connected to each other by the stairs 30 and therefore persons can escape from each floor to the ground GL easily. There is no problem on the underground construction 10 in a point of safety. In the illustrated embodiment, there are two stairs 30 which are symmetric to the center line of the underground construction 10.

Without being limited thereto, the number of stairs 30 may be one, or three or more. When there are many stairs, it is preferable that they are separated circumferentially at equal intervals. On the floor at the ground GL, the space capable of use is large and therefore many people may stay in the space. Additional stairs may be disposed so that the floors near the ground GL, for example, B1–B3 are connected to each other. These stairs are useful for emergency because all people can escape from the underground construction in a short time.

Figure 10:
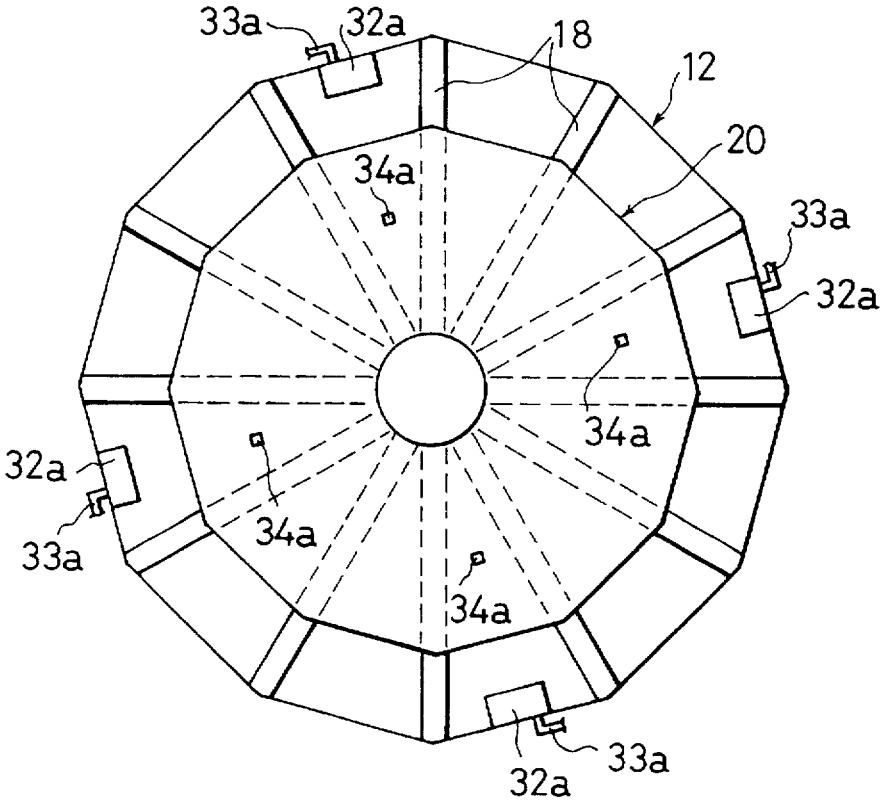
FIG. 10 is a cross section view of the underground construction taken along the line B—B in FIG. 3.
Figure 11:
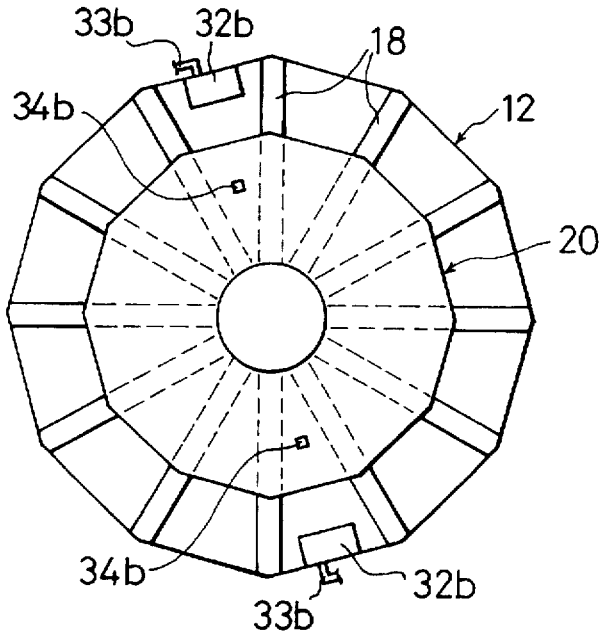
FIG. 11 is a cross section view of the underground construction taken along the line C—C in FIG. 3.

Next, an embodiment of the underground construction having air-conditioning facilities according to the present invention will be described herein below with reference to FIGS. 9–11.

Figure 9:
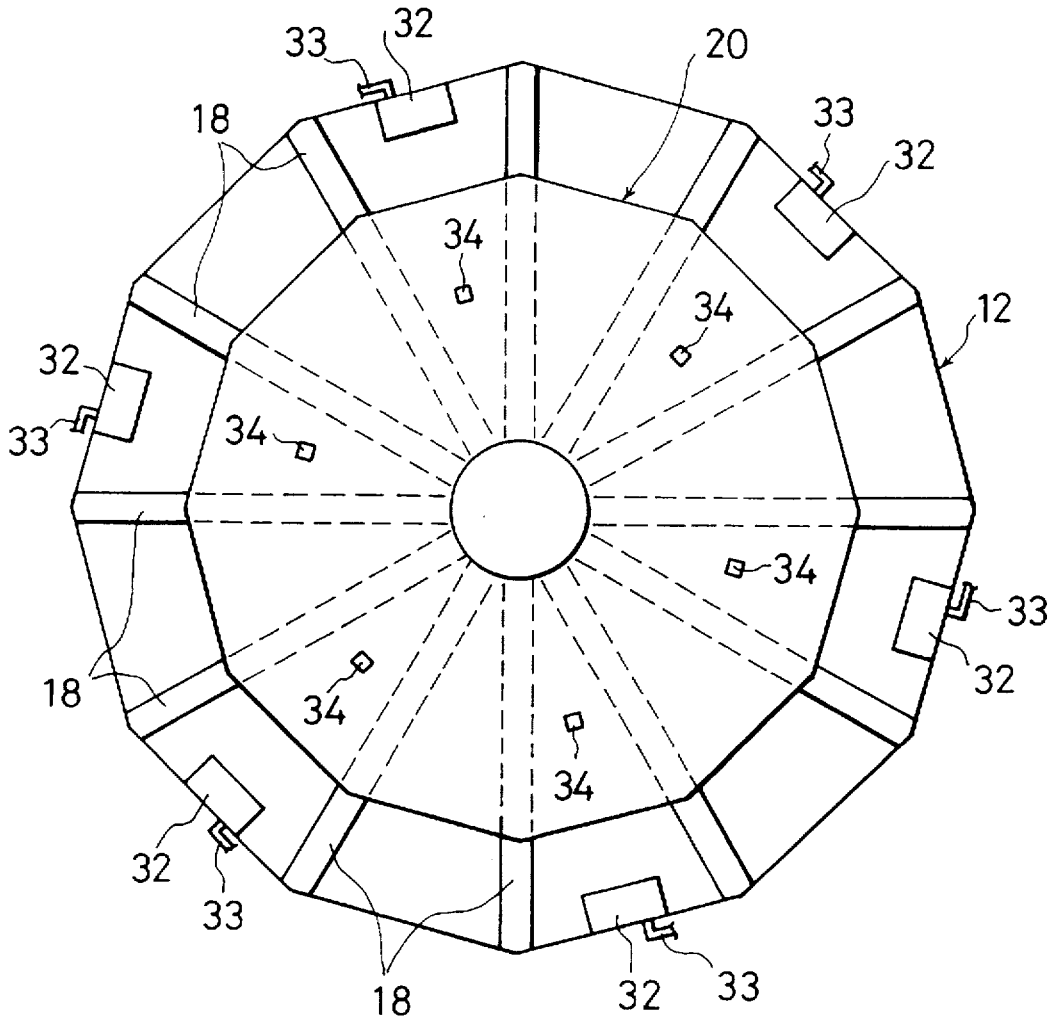
FIG. 9 is a cross section view of the underground construction taken along the line A—A in FIG. 3.

FIG. 9 is a cross section view of the underground construction taken along the line A—A in FIG. 3. FIG. 10 is a cross section view of the underground construction taken along the line B—B in FIG. 3. FIG. 11 is a cross section view of the underground construction taken along the line C—C in FIG. 3.

As shown in FIG. 9, six small cascade portions 32 are disposed at the circumference wall 12 at a fixed interval. The small cascade portion 32 is located at a position outside of the floor plate 20 of the floor construction body 16. Small cascade portion 32 has the operation device that is not illustrated. The operation device makes the water stream in a selected cascade or makes the water stop. Temperature sensor 34 for detecting the room temperature is provided at suitable positions on the floor plate 20.

Temperature sensor 34 is provided corresponding to each small cascade portion 32. When the temperature sensor 34 detects a temperature over the predetermined limit, water streams in the small cascade by the operation device until the room temperature goes down to the predetermined level. The temperature near the small cascade portion 32 can be decreased by vaporization heat of water.

Water may stream in the selected small cascades independently corresponding to each temperature sensor 34. Alternatively, water may stream in all cascades at the same time. In this case, the number of the temperature sensors 34 can be decreased. Further, the quantity of water can be adjusted according to the temperature detected by the temperature sensor 34. When the quantity of water is large, cooling capability is increased. In the embodiments shown in FIGS. 10 and 11, the small cascades 32*a*, 32*b* and the temperature sensors 34*a*, 34*b* are provided. The operation and function of these small cascades and temperature sensors are the same as those of FIG. 9.

Although the small cascades shown are disposed for each floor independently, they may instead be long ones which extend over several floors. This kind of air-conditioning device is especially suitable for the floor construction body of open type because the space formed on the floor plate 20 is not isolated from the outer fresh air.

However, this kind of air-conditioning device is useful for the floor construction body of closed type too because the temperature difference between the outside and the inside of the room becomes small.

The underground construction with another type of air-conditioning device will be explained herein below.

Figure 12A:
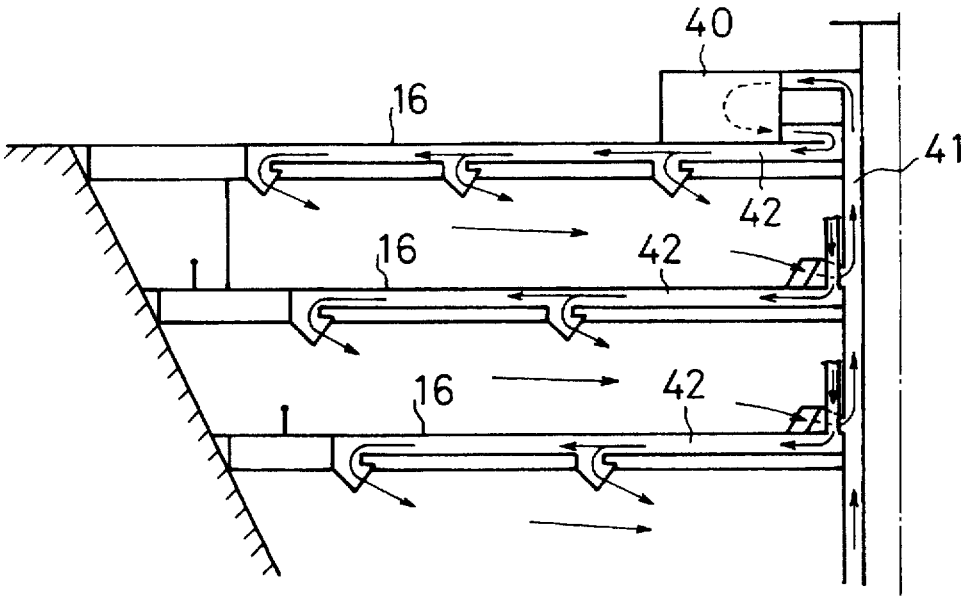
FIG. 12 (*a*)–(*b*) are partial vertical section views showing other embodiments of the underground constructions, respectively.
Figure 12B:
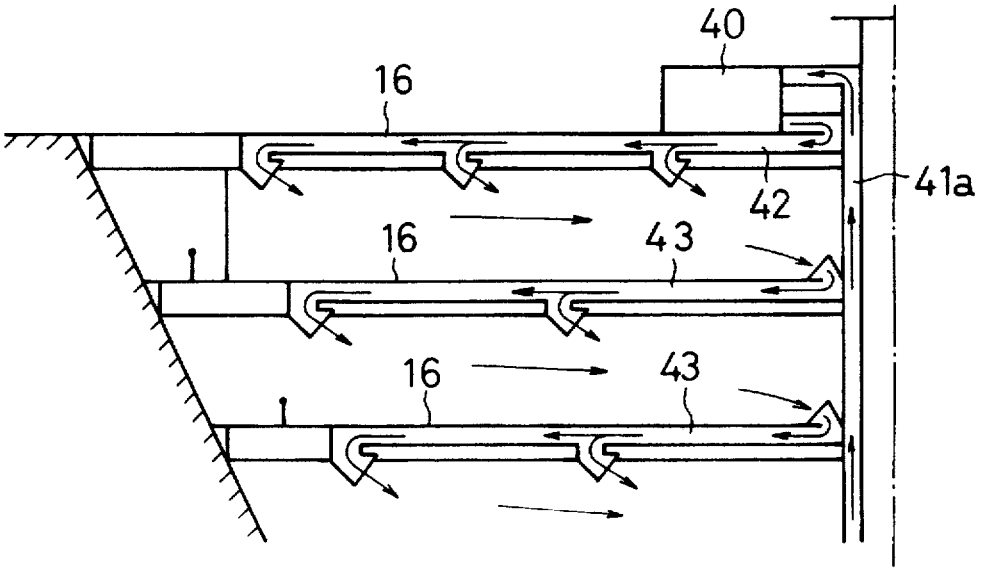

FIG. 12(*a*) is a partial vertical section view showing a preferred embodiment of the underground construction with air-conditioning facilities.

In the drawing, the reference number 40 is a generator. Center duct 41 and plural first ducts 42 are connected with this generator 40. Center duct 41 is disposed in the elevator facility 24 and pierces from the lowest floor to the top floor. The center duct 41 sucks air blown out to each floor at the lower center position thereof and directs the air to the generator 40. This cooled air blows out over each floor from an upper peripheral position to the center thereof through the first ducts 42 which are disposed for each floor independently. In the drawings, an arrow of a one point chain line represents a flow of the air cooled by the generator 40. An arrow of a solid line represents a flow of the air that is returned to the generator 40.

The air is blown to each floor and is sucked at the lower center position thereof. The plural first ducts 42 are provided for each floor independently and therefore cooling of each floor can be controlled deliberately. Further, for each floor a number of such first ducts 42 can be provided. Opening/closing the first duct 42 are controlled in the same manner as for the small cascades 32.

Next, another embodiment of the underground construction having air-conditioning facilities according to the present invention will be herein below explained.

FIG. 12(*b*) is a partial section view of another embodiment of the underground construction according to the present invention.

In this embodiment, instead of the first ducts 42 the third ducts 43 are provided for each floor. The third duct 43 sucks air which has been blown out to the floor at the lower center position thereof. The third duct 43 includes a blowing mouth which blows air to the lower floor construction body from its peripheral position toward the center thereof. At the lowest floor, the air blown from the third duct 43 is sucked at the lower center position and is returned to the generator 40 through the center duct 41*a*. This center duct 41*a* is disposed in the elevator facility 24 and pierces from the lowest floor to the top floor. This center duct 41*a* is different from the center duct 41 as shown in FIG. 12(*a*) in that it communicates with only the lowest floor.

Next, the operation of the air-conditioning facilities will be described. Through the center duct 41*a*, heated air is returned to the generator 40 from the lowest floor. This air is cooled by the generator 40 and the air cooled is blown out to the highest floor from the upper peripheral position toward the center thereof. By this, the highest floor where cold air is introduced has been cooled. Then, the air is sucked by the third duct 43 at the lower center position of the highest floor and is directed to the peripheral position of the lower floor directly there below.

In the same manner as of the highest floor, the B2 floor is cooled by this cooled air. Air-conditioning is successively conducted in this manner from the upper floor to the lower floor. And from the lowest floor, the air of high temperature is returned to the generator 40 by means of the center duct 41*a* as previously described. In the underground construction, the floor near the ground GL has a higher temperature and the floor of lower level has a lower temperature. Therefore, the air-conditioning facility as described above is suitable because it accords with the above-mentioned features of the underground construction.

Another embodiment of the underground construction having an air-conditioner device according to the present invention will be explained.

Figure 13:
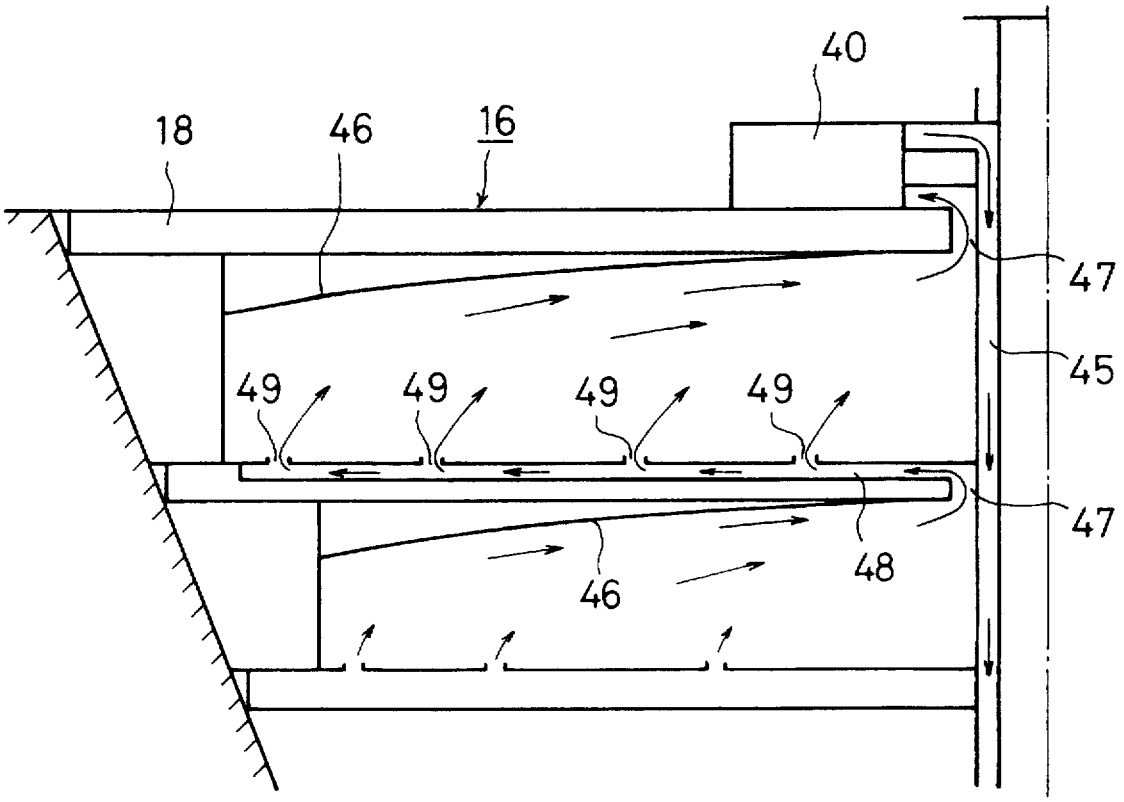
FIG. 13 is a partial vertical section view showing a further embodiment of the underground constructions in accordance with the invention.

FIG. 13 is a partial section view of the underground construction according to the present invention. In the drawing, the reference number 40 represents a generator.

The center duct 45 which is disposed in the elevator facilities 24 is connected with this generator 40. The central duct 45 blows hot air from the generator 40 to the lowest floor. The ceiling member 46 is equipped to the under side of each floor construction body 16. The ceiling member has a spherical surface. The center of the ceiling member 46 is formed with a collecting mouth 47.

The collecting mouth of the highest level communicates with the generator 40 and other collecting mouths 47 are fitted with the floor ducts 48. The floor ducts 48 are disposed radially and are fitted with plural connecting ducts 49 which direct hot air to the upper floor. The connecting ducts 49 are provided intermittently in a radial direction.

In the air-conditioning facilities assembled as described above, air is heated by the generator 40. Then, heated air is directed to the lowest floor through the center duct 45. The air directed to each floor has a tendency to going upwardly. Therefore, the air is gathered at the collecting mouth 47 of the ceiling member 46 which is provided at the underside of each floor construction body 16. Then, the heated air is directed into the floor ducts 48 and spreads over the upper floor construction body 16 through the plural connecting ducts 49. In this manner, each of floors is heated. Finally, the air is returned to the generator 40 by means of the collecting mouth 47 of highest floor construction body 16.

In the preferred embodiment illustrated in the drawings, the ceiling member is of a spherical surface. Without being limited thereto, any shape which is capable of gathering air near by the collecting mouth of the ceiling member can be adapted. For example, polygonal pyramids or cone shaped members can be used.

Figure 14:
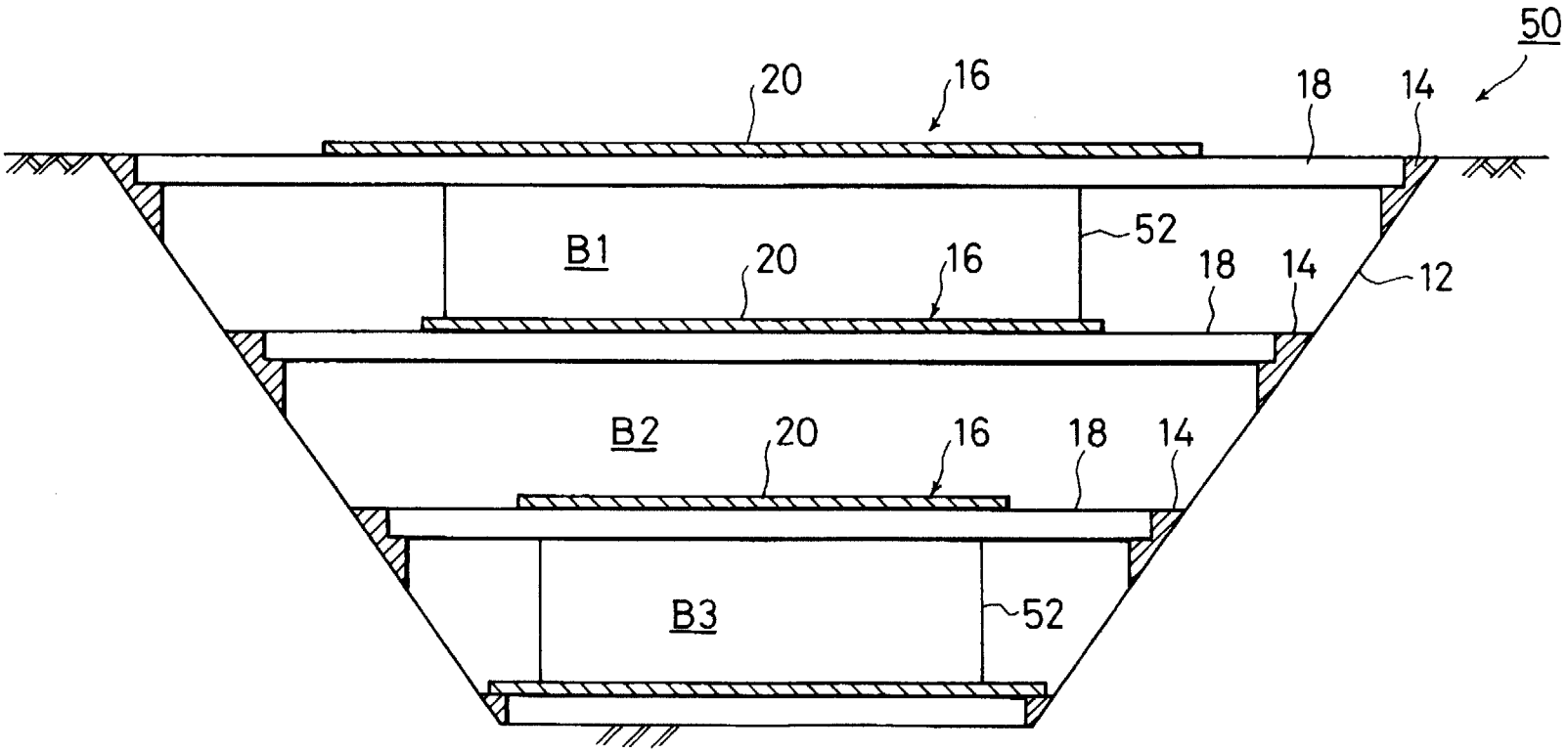
FIG. 14 is a vertical section view showing a further embodiment of the underground construction in accordance with the present invention wherein noises are intercepted at a floor interval.

Next, the underground construction wherein noise is intercepted at a floor interval will be explained with reference to FIG. 14.

The underground construction 50 illustrated has a 3-floor organization.

End of the bed beams 18 of each floor construction body 16 is supported by the support members 14 which are disposed at the circumference wall 12. Assuming that each floor is named as B1, B2, B3 - - - from top to bottom, the floor B1 and the floor B3 are the floor construction body of closed type wherein a closed space or room isolated from the outer fresh air is provided. This room is defined by vertically adjacent paired floor construction bodies 16 and partitions 52 such as glass plates, outer wall plates, etc. People live in this closed space or room and work therein.

To the contrary, the floor B2 is the floor construction body of open type wherein air can pass through freely. Outer fresh air directly flows in and out between the floor plates 20 of the vertically adjacent paired floor construction bodies. Though it is not illustrated in the drawings, the height of the floor B2 may be smaller or larger than those of the floors B1 and B3. In the illustrated embodiment, at least one floor B2 of open type is interposed between the floors B1 and B3 of closed type.

There is no pillar which transmits noises freely between the vertically adjacent floors. Because of this, noises on floors B1 and B3 are transmitted through the following course to other floors. This course is constituted by the bed beams 18 of the floor construction body 16, the support members 14, the circumference wall 12 and the bed beams 18 of the adjacent floor construction body 16. The sound transmitted through this course is very small. Noise occurring in this closed space of the floors B1 and B3 is also transmitted through air on the floor B2 of open type to the other floors disposed above or under said floor. Compared to the quantity of noises transmitted through the steel bed beams, it is very small or roughly zero.

In another preferred embodiment, the floor B2 of open type provides area for a park, a garden or agricultural field. This area is also used as rest area for persons using the underground construction 50. With this kind of area, noise is hardly transmitted through the air existing in the floor B2 of open type.

Figure 15:
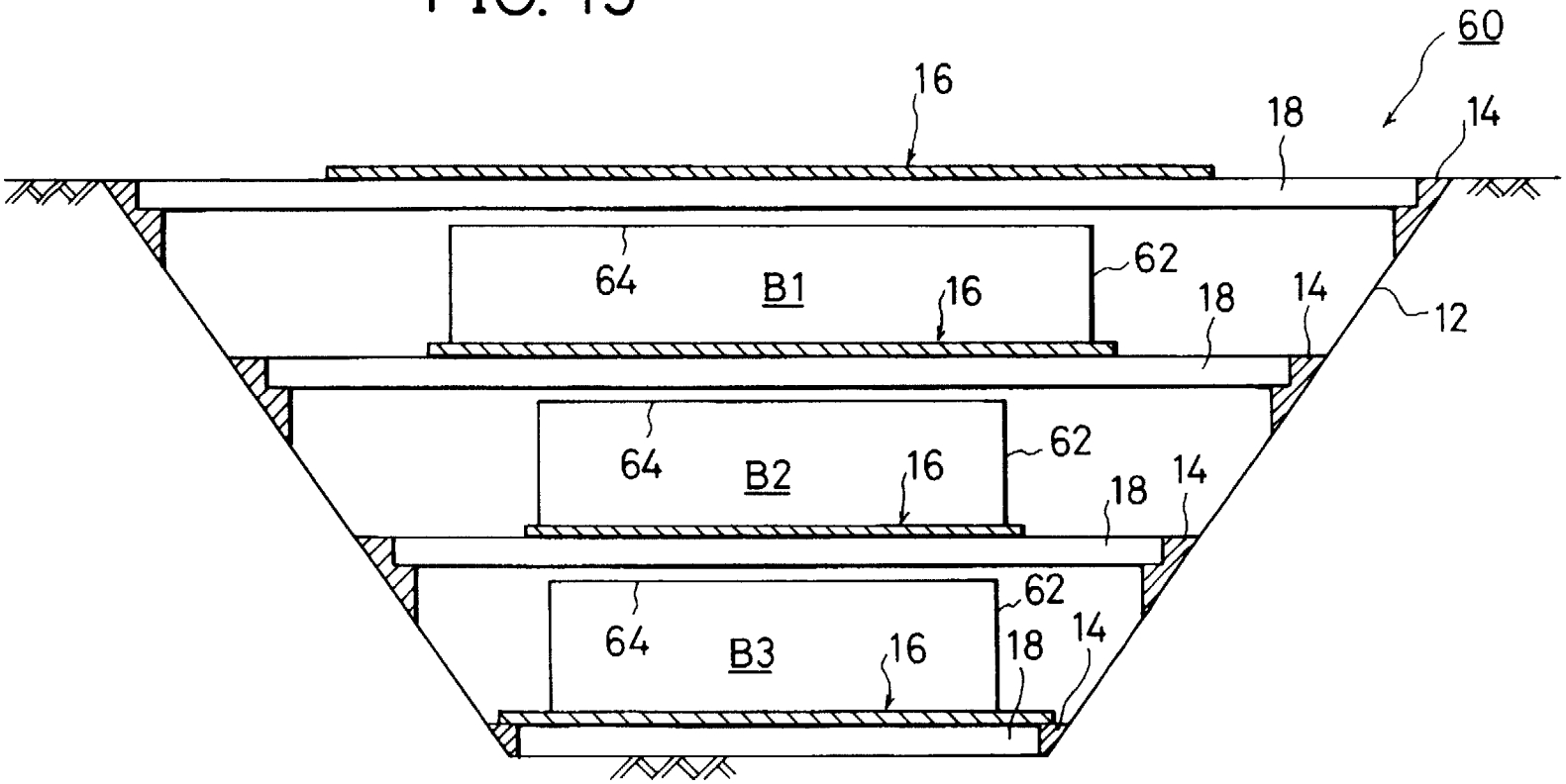
FIG. 15 is a vertical section view showing a further embodiment of the underground construction in accordance with the present invention wherein noises are intercepted at a floor interval.

Next, the underground construction wherein noise is intercepted at a floor interval will be explained with reference to FIG. 15.

The underground construction 60 illustrated has a 3 floor organization. Each floor construction body 16 is supported by the support members 14 which are disposed at the circumference wall 12. Assuming that each floor is named as B1, B2, B3 - - - from top to bottom, on the floor plates 20 of each floor construction body 16 except the top one, a closed space or room isolated from the outer air is provided. This room is defined by ceiling plates 64 and partitions 62 such as glass plates, outer wall plates, etc.

Therefore, all floors B1, B2, B3 comprise the floor of closed type and therefore there is a space between the ceiling members 64 of each floor and the floor plate 20 of the upper floor. Because of this, noises of each floor are transmitted through the following course to other floors. This course is constituted by the bed beams 18 of the floor construction body 16, the support members 14, the circumference wall 12 and the bed beams 18 of the adjacent floor construction body 16. The sound transmitted through this course is very small. Noise occurring on each floor is also transmitted through the space between the ceiling members 64 of each floor and the floor plate 20 of the upper floor. Compared to the quantity of noises transmitted through the steel bed beams, it is very small or roughly zero.

In both embodiments described above, the support members supporting the bed beams of the floor construction body can be offset in a circumference direction between the vertically adjacent paired floors.

The sound transmitted through the circumference wall 12 becomes further small. In the illustrated embodiments, the underground construction 50, 60 have 3 floor organization, however, it is not limited thereto. The underground construction wherein noise is intercepted at a floor interval is hardly influenced by noise at the ground GL so that a quiet environment can be provided. Since noise occurring in each floor is interrupted at a floor interval, the underground construction according to the present invention is especially suitable for facilities needed to be quiet, such as a library, a hospital or an apartment. Further, it is good for families of two generations when it is small scale.

Referring to FIG. 3 again, the underground construction has a water tank 25 at the bottom of the cone shaped space.

When rain comes down, rainwater goes inside the underground construction 10 through the space formed between the circumference wall 12 and the floor plate 20. The circumference wall 12 of the underground construction has a conical shape.

Rainwater goes down along the circumference wall 12 to the bottom of underground construction 10. The circumference wall 12 is formed with a side ditch (not illustrated) which extends horizontally around the circumference wall 12. The circumference wall 12 is also formed with a downpipe (not illustrated) which directs water from the side ditch to the water tank 25. The side ditch can be disposed such that it receives water from the small cascades 32. Accordingly, the rain water enters into the water tank 25 established in the bottom of cone shape space and is collected there. Rainwater is never thrown away in sewage or a river.

Rainwater is saved in the water tank 25 and is utilized for various kinds of uses in an optimum fashion. Rainwater is used for example for fire extinguishing or water for air-conditioning of each floor. This water can be supplied from the water tank 25 to the small cascades 32 through pipeworks 33. Air-conditioning near by the circumference wall 12 can be conducted by vaporization heat of water streaming in the cascades 32.

Alternatively, pipeworks can be disposed so that a heat medium circulates between the water tank 25 and each floor of the underground construction such that a heat medium gives heat to or takes heat from the water. In such embodiment, water stored in the water tank 25 can be used as heat source. By returning the water streaming in the small cascade 32 to the water tank, the temperature of the water stored in the water tank 25 can be decreased.

In this system, the water in the water tank 25 is used as heat source for cooling. On the other hand, the water in the water tank 25 can be used as heat source for heating. For example, the water may be heated during night time by using less expensive night electric power.

Referring to FIG. 3 again, a drain hole 26 may be formed in an inclined fashion at a position near the ground GL of the circumference wall 12. This drain hole 26 may be inclined slightly downwardly at an angle a with respect to a horizontal line.

When the water level of the water tank 25 exceeds the safety level, the water is disposed of from the underground structure through the drain hole 26 by means of the pipeworks 27. This drain hole 26 can be used as pipes for distributing water to plants or trees by using routes under the ground surface and therefore water in the water tank 25 is usefully utilized for cultivating plants.

The underground construction for parking lots will be explained with reference to FIG. 16 in detail. The size of the underground construction 10 is a diameter of about 40 m at ground GL, the depth being approximately 20 m. In the illustrated embodiment, the underground construction has a 6-floor organization, however, it is not limited thereto.

The underground construction may have any number of floors. The height of each floor may be the same or may be different from each other. Large size cars such as trucks and buses are classified differently from normal size cars and are arranged to park in a different floor the height of which is higher than that of the floor for the normal cars. With this arrangement, the underground parking lot 70 can be used effectively for parking from a three-dimensional view point.

As best shown in FIG. 16, a circumference wall 12 the shape of which is a cone or polygonal pyramid is formed by digging into the ground GL downwardly. The angle between the circumference wall 12 and a horizontal line is voluntary. When this angle is large, the number of floors can be increased.

The floor construction body 16 is constituted by the radially spreading bed beams 18 and the floor plates 20 supported on the bed beams 18. Car M parks and runs on the upper surface of this floor plate 20. As best shown in FIG. 16, the floor plate 20 inclines slight downwardly from the center to the circumference wall 12. Exhaust gas of car M is heavier than air and it gathers on the surface of the floor plate 20. Because of the downward inclination of the floor plate 20 from the center to the circumference wall 12, the exhausted gas drifts radially and drops off from the floor plate 20 to the lower floor. Floor plate 20 of the lower floor is shorter than that of the higher floor. Therefore, the exhausted gas dropped off from the floor plate 20 moves along the inclined circumference wall 12 without going into the floor plate 20 of the lower floor construction body 16. In the preferred embodiment as shown in FIG. 16, the exhaust gas receptacle 21 is disposed at the position under the floor plate 20 of the lowest floor. The exhaust ventilation duct **24*a* may be disposed in the elevator facilities 24 and communicates between the exhaust gas receptacle 21** and the ground GL.

When an exhaust gas detector (not illustrated) detects a gas concentration over the permissible limit, exhaust gas in the exhaust gas receptacle 21 is forcibly exhausted to the ground GL through the exhaust ventilation duct **24*a*. The features of the present underground construction for parking lots reside in the point that no pillar is needed for each floor because the floor construction body 16 is supported by the plural support members 14 which are disposed at the circumference wall 12 vertically at the same height. However, as shown in FIG. 16, when the scale of the floor construction body 16 is large, it is preferable that the floor construction body 16 is also support near the center position thereof. The underground construction for parking lots 70 includes car elevator facilities 24** at the center position thereof.

A plurality of pillars 23 for also supporting the center position of each floor construction body 16 are provided around the car elevator facilities 24.

Figure 17:
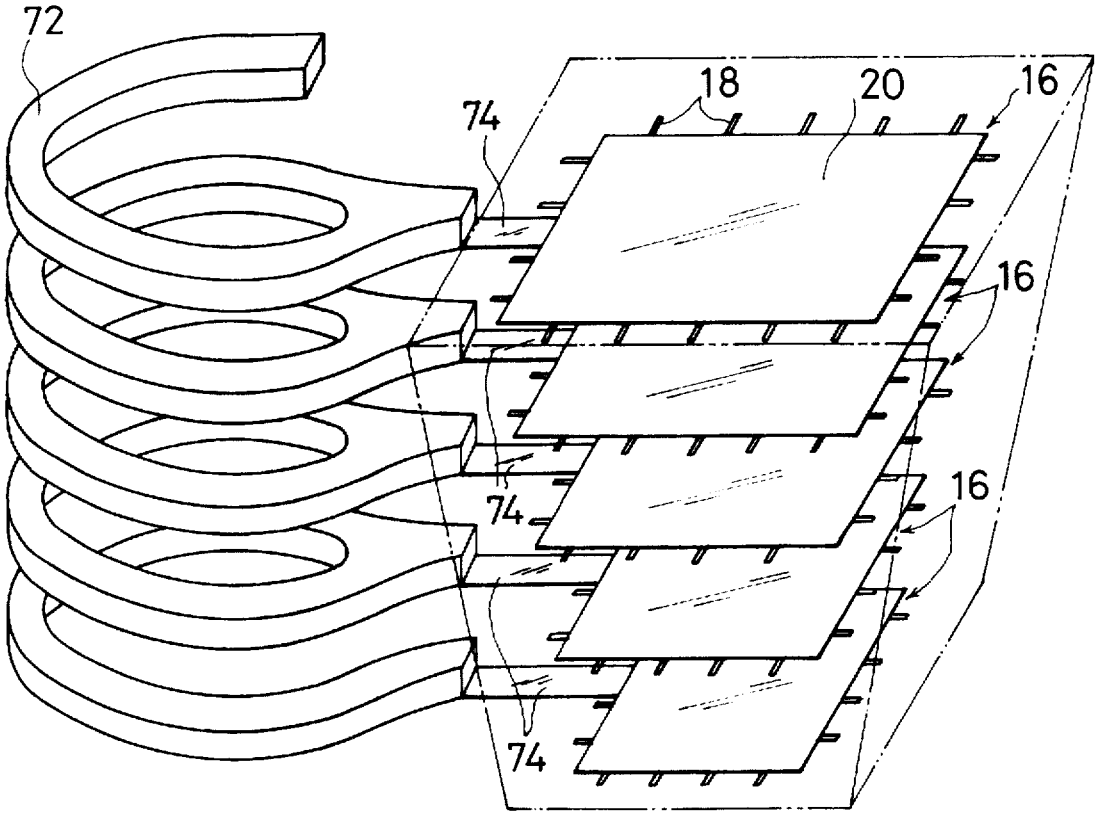
FIG. 17 is a vertical section view showing other embodiment of the underground construction for parking lots in accordance with the present invention.

Another embodiment of the underground construction for parking lots according to the present invention will be explained herein below with reference to FIG. 17. In the drawing, only a tunnel and a floor construction body are drawn in solid line for better understanding and other elements being drawn generally in one dot chain line. The circumference wall 12 illustrated in one dot chain line has a rectangular plane shape, the size of which becomes smaller downwardly.

Figure 18:
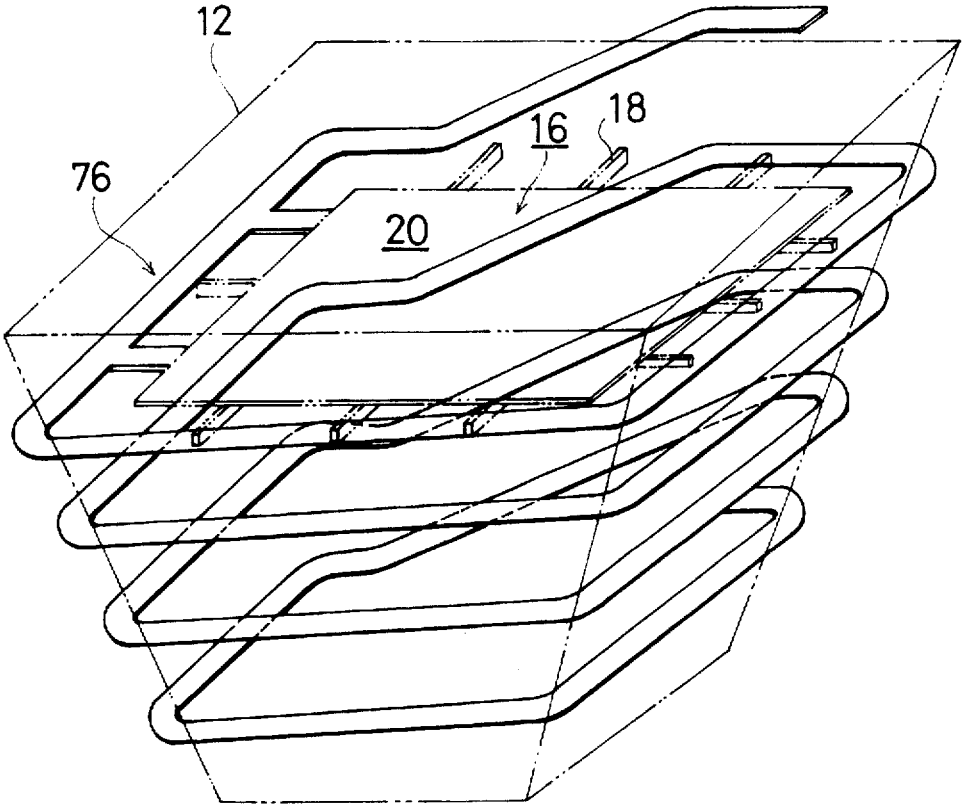
FIG. 18 is a vertical section view showing another embodiment of the underground construction for parking lots in accordance with the present invention.

A spiral tunnel 72 is formed outside of the circumference wall 12. The connecting passages 31 diverge from the tunnel 72 at positions corresponding to each floor construction body 16 and are connected to each floor construction body 16 in a horizontal direction. In the illustrated embodiment, the tunnel is of spiral shape. However, it is not limited thereto and the tunnel can be various kinds of shapes. FIG. 18 shows another embodiment of the underground construction for parking lots. In the drawing, only a spiral circumference passage and a floor construction body are drawn in solid line for better understanding and other elements being drawn generally in one dot chain line. In this embodiment, the spiral circumference passage 76 is provided around the circumference wall 12 instead of the tunnel 72. The circumference passage 76 goes down vertically by, one floor while it runs around the circumference wall 12.

This level down of the spiral circumference passage 76 may be carried out at one side or at two sides of the circumference wall 12 which has a rectangular plane shape.

Figure 19:
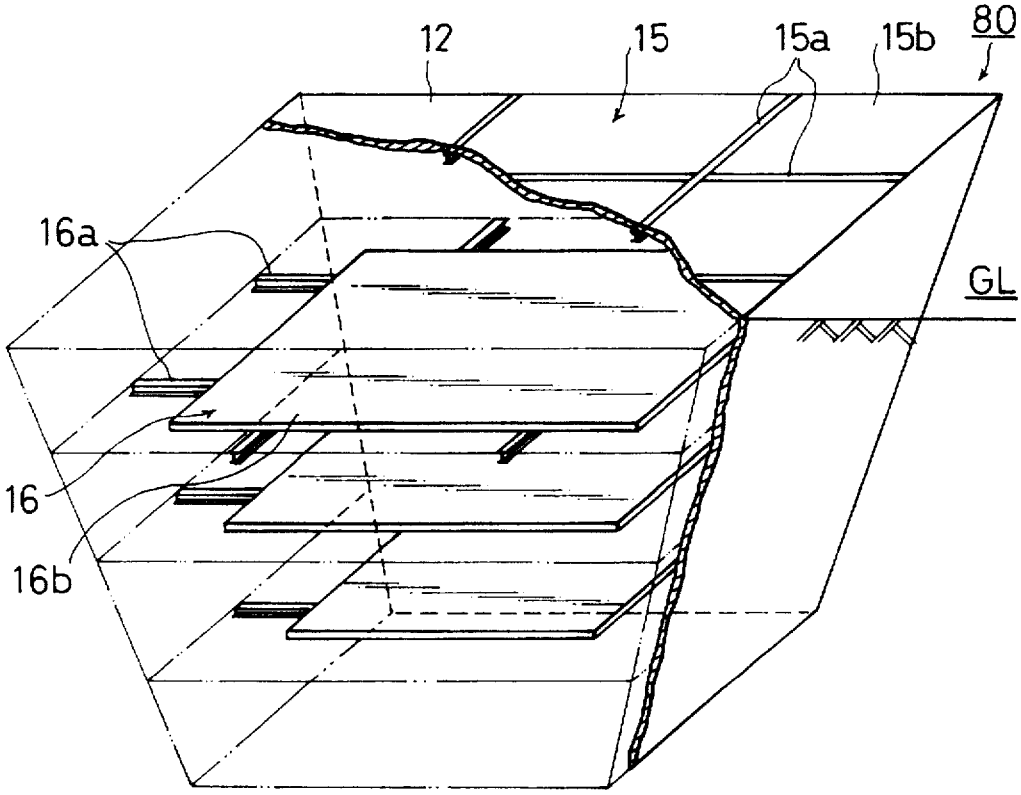
FIG. 19 is a perspective view showing another embodiment of the underground construction for a greenhouse in accordance with the present invention.
Figure 20:
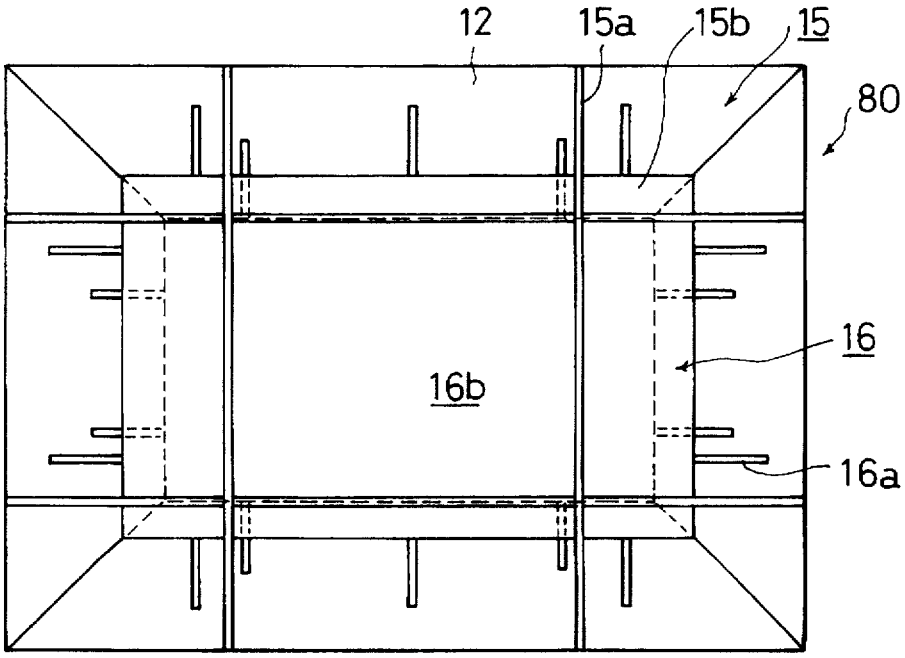
FIG. 20 is a plan view showing the underground construction for a greenhouse as shown in FIG. 19.
Figure 21:
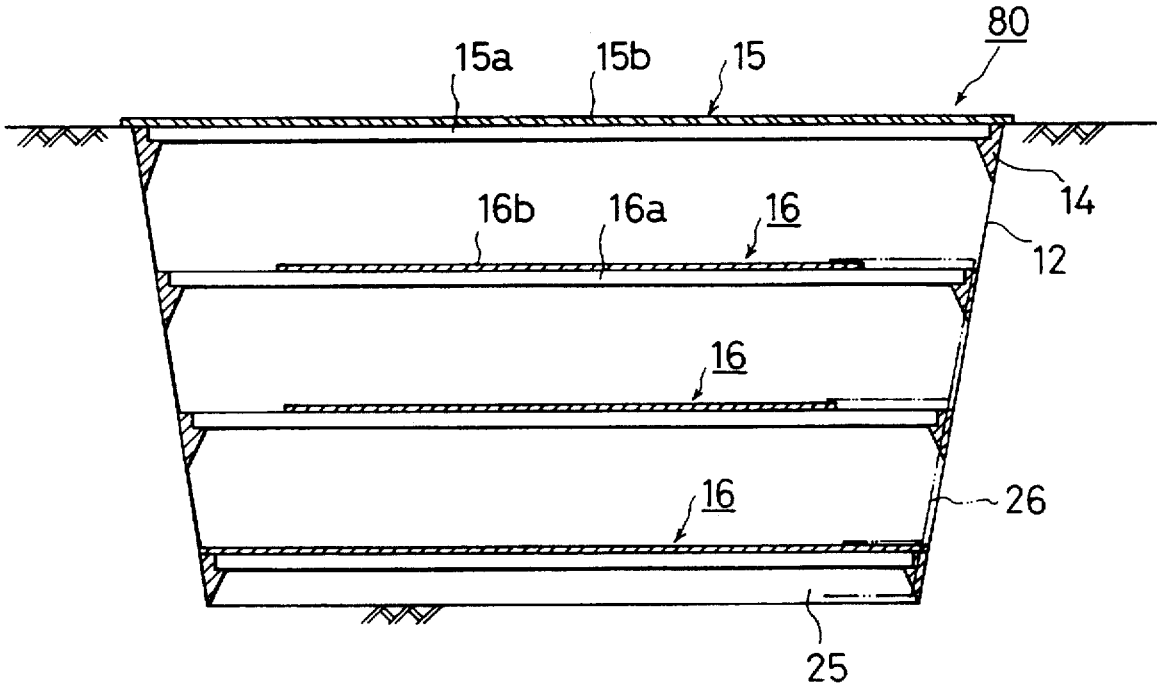
FIG. 21 is a vertical section view showing the underground construction for greenhouse as shown in FIG. 19.

An embodiment of the underground construction for a greenhouse according to the present invention will be explained with reference to FIGS. 19–21. In FIG. 19, a part of the underground construction for a greenhouse has been cut out for the sake of a better view of the greenhouse.

The illustrated underground construction 80 for a greenhouse generally comprises a circumference wall 12 defining a cone shaped space, plural support members 14 which are disposed at the circumference wall 12 at vertically the same height, a ceiling construction body 15 which covers the whole upper surface of the cone shaped space, and floor construction bodies 16 supported by the plural bed beam members 16*a*.

The size of the underground construction 10 is about 40 m×30 m at ground GL, and depth being approximately 8 m. In the drawing, the depth direction is exaggerated. In the illustrated embodiment, the underground construction for greenhouse 80 has a 3-floor organization, however, it is not limited thereto. The underground construction may have any number of floors. The height of each floor may be the same or may be different from each other.

When much sun light is necessary for plants to cultivate, it is preferable that light reflection means are provided on the surface of the circumference wall 12. It is also preferable that further reflection means are provided on the under side of the ceiling construction body 15 and the floor construction body 16. The ceiling construction body 15 has beams 15*a* and ceiling panels 15*b*.

The ends of the beams 15*a* are supported by several support members 14 of the highest group. The ceiling panels 15*b* are supported by the beams 15*a* and covers over the cone shaped space wholly. The ceiling panel 15*b* is made of transparent materials such as glass plates, vinyl sheets etc. The ceiling panels 15*b* can be of separate type and any number of the ceiling panels can be opened/closed for ventilation or temperature control.

The floor construction body 16 is constituted by plural bed beams 16*a* extending horizontally and a plants cultivating area 16*b*. There is space between the outer edge of the plants cultivating area 16*b* and the circumference wall 12. When the length of this space is large, much sun light can be supplied to the lower floor. In each floor construction body 16, transparent panels can be disposed between the outer periphery of the plants cultivating area 16*b* and the circumference wall 12 so that each plants cultivating area 16*b* is thermally isolated from that of other floors.

Though it is not illustrated, there may also be provided an elevator. Stairs may be provided for accessing to the plant cultivating area 16*b* of the floor construction body 16. The underground construction for greenhouse 80 has a feature that is hardly influenced by the outer temperature change because it exists in the underground. Therefore, in winter, it is heated by the ground so that energy for warming the room can be decreased.

Referring to FIG. 21 again, the illustrated preferred embodiment has the water tank 25 at the bottom of the cone shaped space. This water tank 25 serves as a receptacle for storing rain water by means of a water gathering funnel (not illustrated) formed at the ceiling construction body 15. Underground water may be also pumped up and stored in the water tank 25.

Water in the water tank is, anyhow, circulated to the plants cultivating area 16*b* though the pipeworks 26. As apparent from the above explanation, the underground greenhouse has a great value as large-scale agricultural greenhouse. Further, the present invention has developed firstly a multi-layer greenhouse for the agricultural business level. The underground greenhouse is extremely sturdy against a typhoon or strong wind. The construction cost is less expensive and intake of sun light can be large. Further, energy for air-conditioning can be decreased because of the ground heat.

Next, an underground construction capable of closing according to the present invention will be described in detail with reference to FIGS. 22–26.

Figure 22:
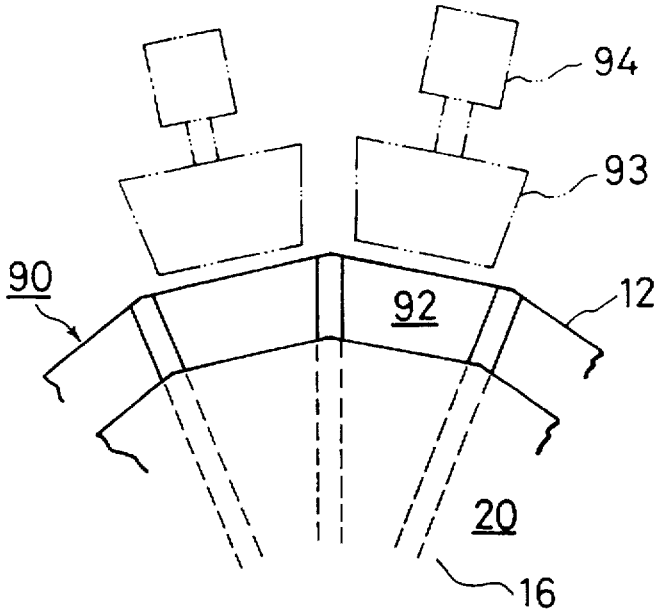
FIG. 22 is a partial plan view showing the underground construction capable of sealing up in accordance with the present invention.
Figure 23:
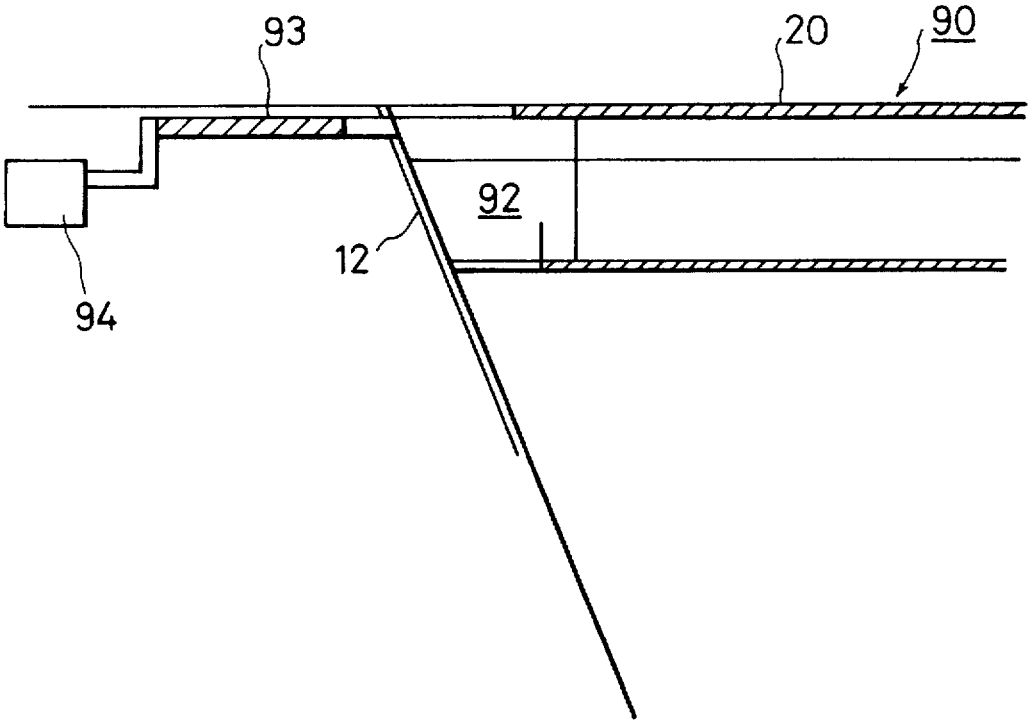
FIG. 23 is a vertical section view showing the underground construction as shown in FIG. 22.

As illustrated in FIGS. 22 and 23, a space 92 is formed between the floor plate 20 of the highest floor construction body 16 and the circumference wall 12. Outside of the circumference wall 12, cover plates 93 for covering the space 92 are embedded. An actuator 94 driving the cover plates 93 radially is provided adjacent to the cover plates 93. The cover plates are preferably made of lead that can intercept radioactivity. The underground construction 90 can be used for a nuclear shelter.

As illustrated in FIGS. 22 and 23, the cover plates 93 are usually moved outwardly by the actuator 94 to uncover the space 92 so that fresh air can enter into the underground construction. In an emergency such as a nuclear war, a big fire or a typhoon, the cover plates 93 are moved inwardly by the actuator 94 to cover the space 92 such that the inside of the underground construction is completely isolated from the outer world. As a result of covering, safety in the underground construction is maintained.

Figure 24:
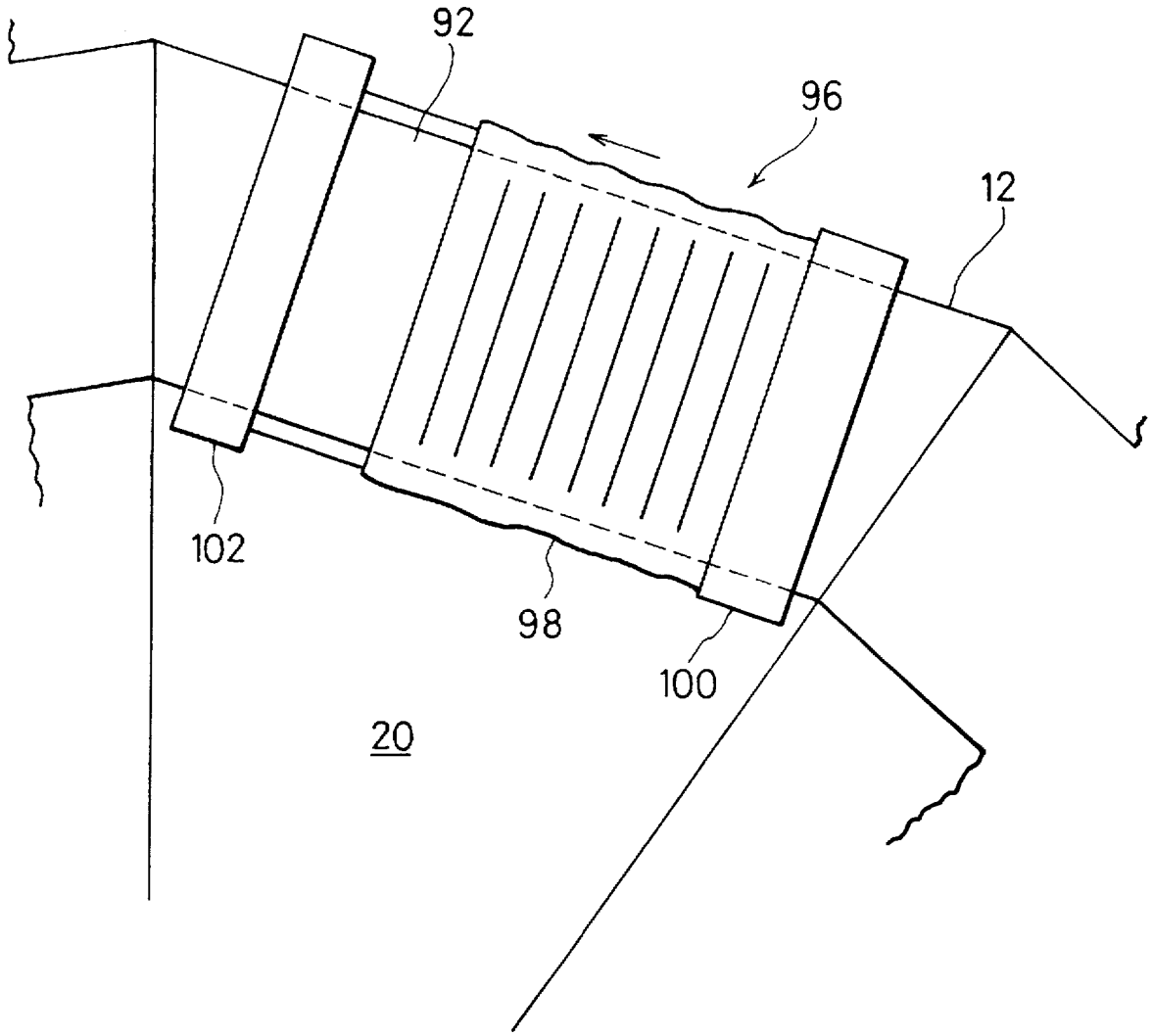
FIG. 24 is a partial plan view showing another embodiment of the underground construction capable of closing in accordance with the present invention.

Next, another embodiment of the invention will be explained with reference to the FIG. 24. In this embodiment, the net winding device 96 is provided. The net winding device 96 comprises a net of a roll 98, a container 100 for enclosing the net 98 and a pull out device 102 for pulling the net 98 out of the container 100. The net may be a black sun shade net or aluminum foil that are suitable for a hot area or region. When needed, the net 98 is pulled out by the pull out device 102 from the container 100 so that sun light is shaded. On the other hand, when sun light is needed to be introduced into the underground construction, the net 98 is rolled into the net winding device 96.

Figure 25:
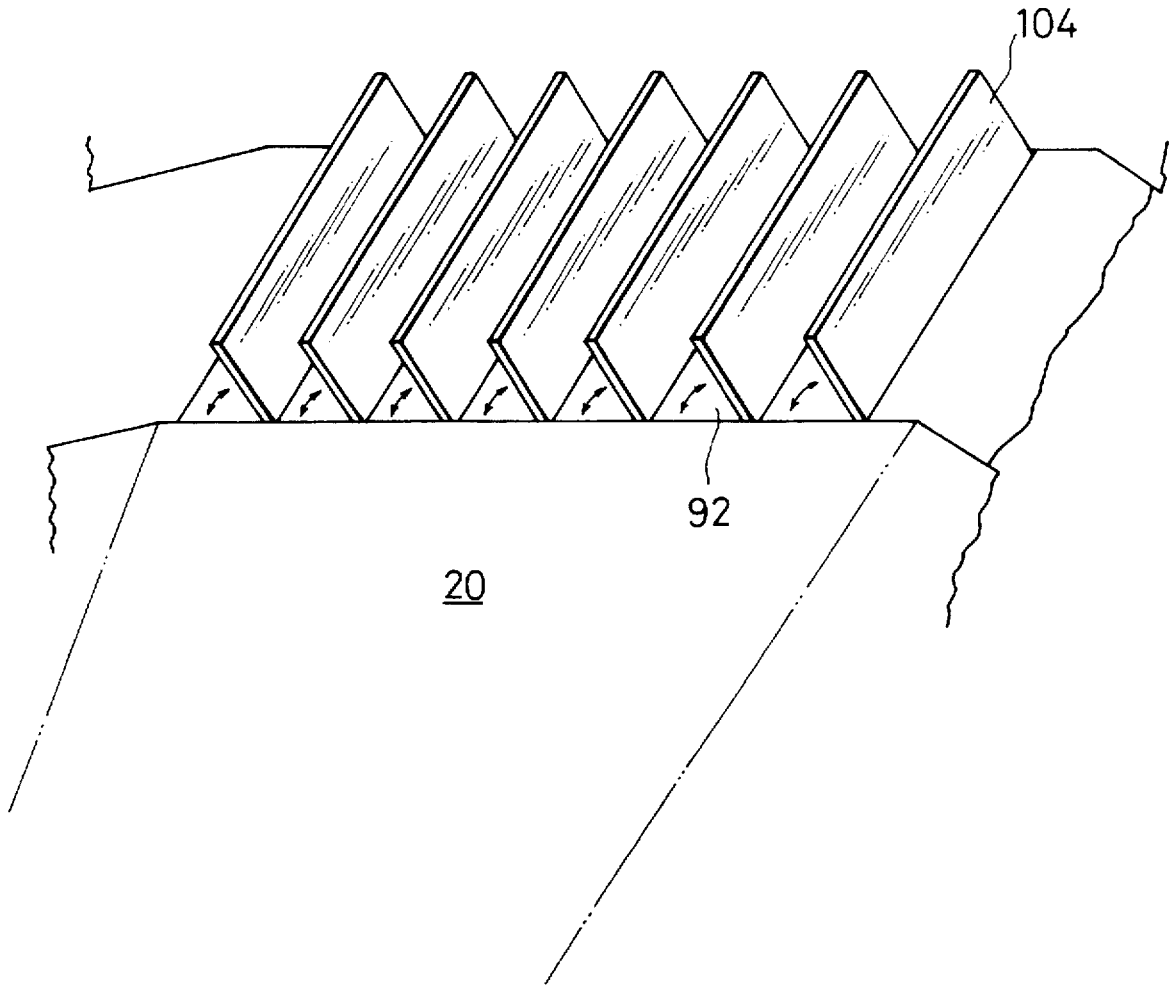
FIG. 25 is a partial perspective view showing another embodiment of the underground construction capable of closing in accordance with the present invention.

Another embodiment of the present invention will be described with reference to FIG. 25. FIG. 25 is a partial perspective view of the flap open/close device. In this embodiment, plural flaps 104 of a blinds type are disposed on the space 92 and driven to open or close by an actuator (not illustrated). The operation or function of the flap 104 is fundamentally the same as that of the net 98. The flap 104 may be adjusted in an inclined position to control the temperature inside the underground construction or intake of sun light.

Light reflection means may be provided on the surface of the flap such that sun light can reach places in the underground construction 90.

Another embodiment of the present invention will be described with reference to FIG. 26.

Figure 26:
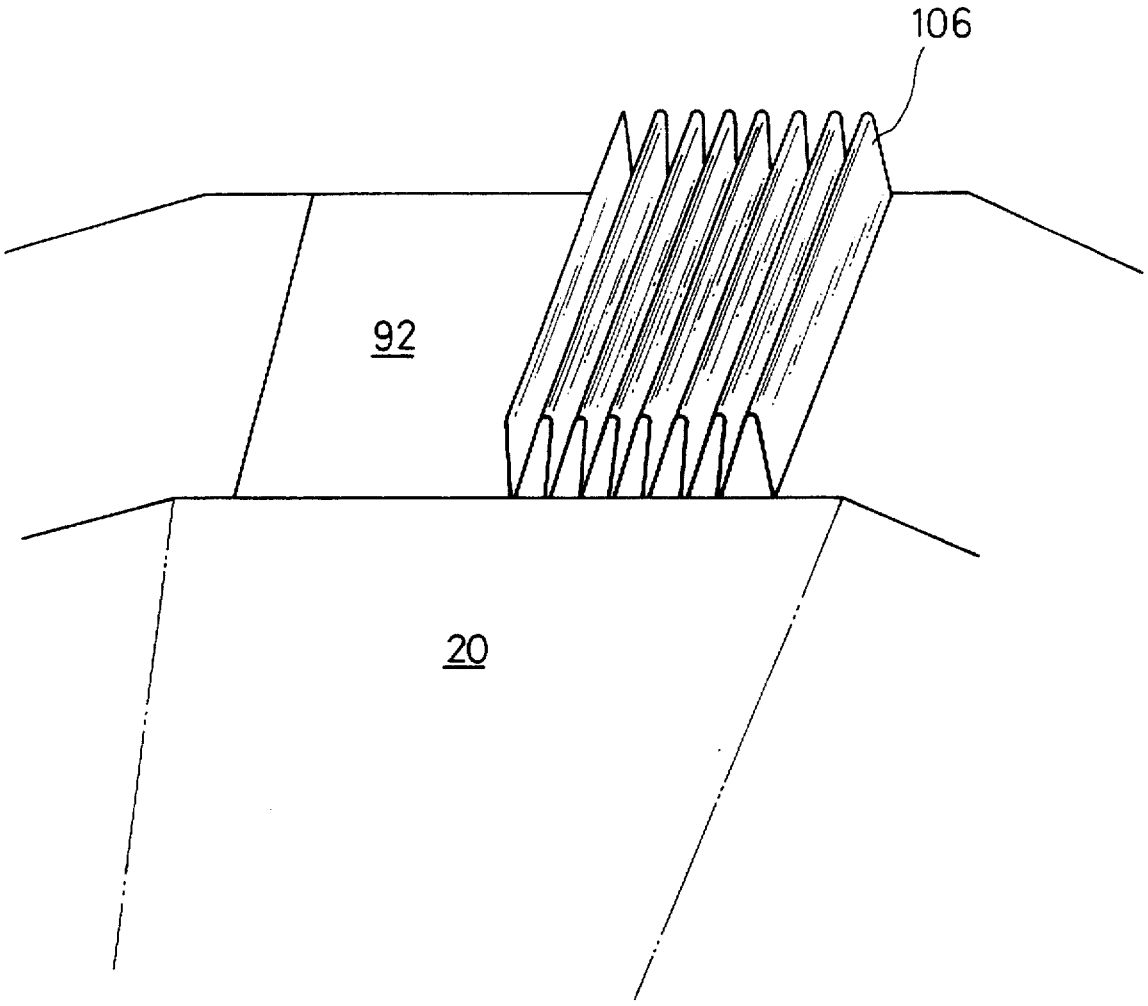
FIG. 26 is a partial perspective view showing a further embodiment of the underground construction capable of closing in accordance with the present invention.

FIG. 26 is a partial perspective view of the bellows type cover open/close device. In this embodiment, a cover 106 of bellows type is disposed on the space 92. The bellows type cover 106 is fixed at its right end in FIG. 26 and is movable at its left end.

The left end of the bellows type cover 106 is connected to a drive device (not illustrated) by which the left end is driven to move rightwardly or leftwardly.

Figure 27:
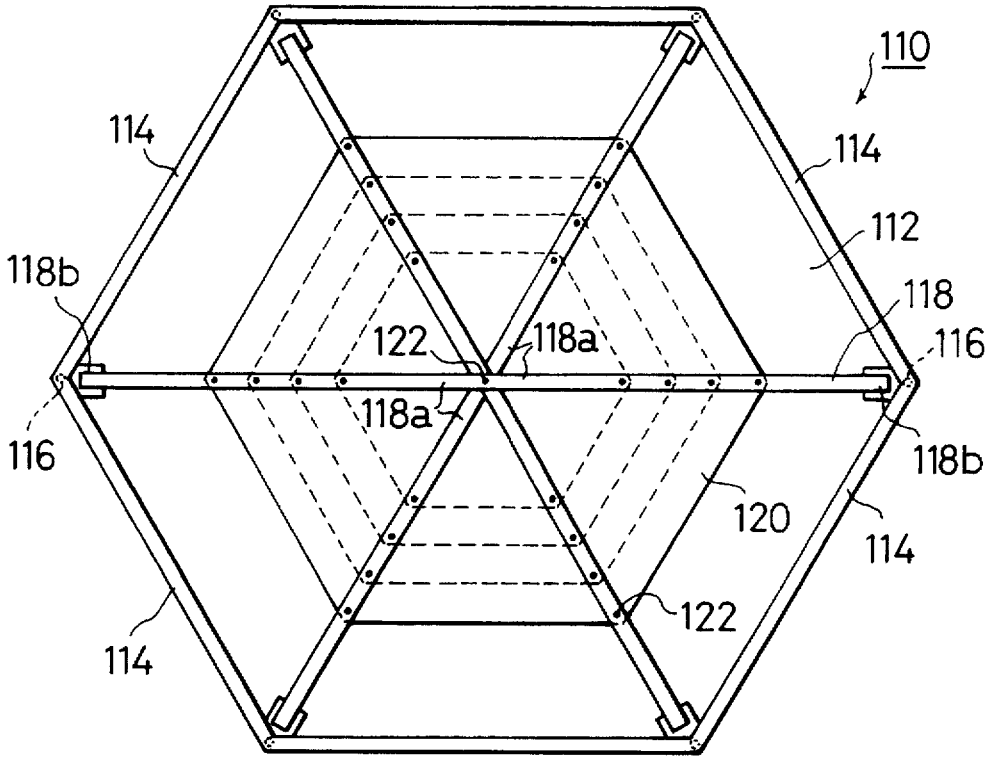
FIG. 27 is a plan view showing the underground construction of floor suspension type in accordance with the present invention.
Figure 28:
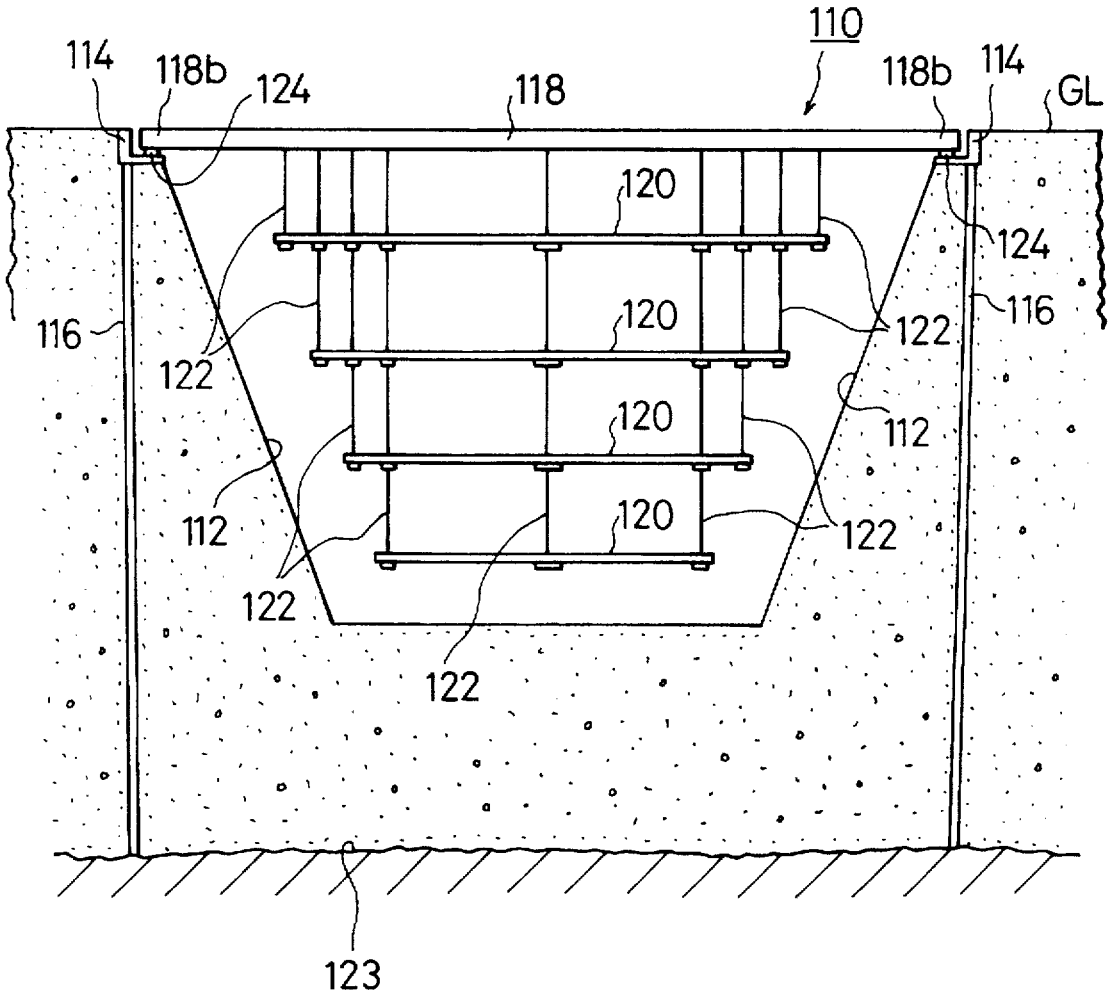
FIG. 28 is a vertical section view showing the underground construction of floor suspension type in accordance with the present invention.
Figure 29:
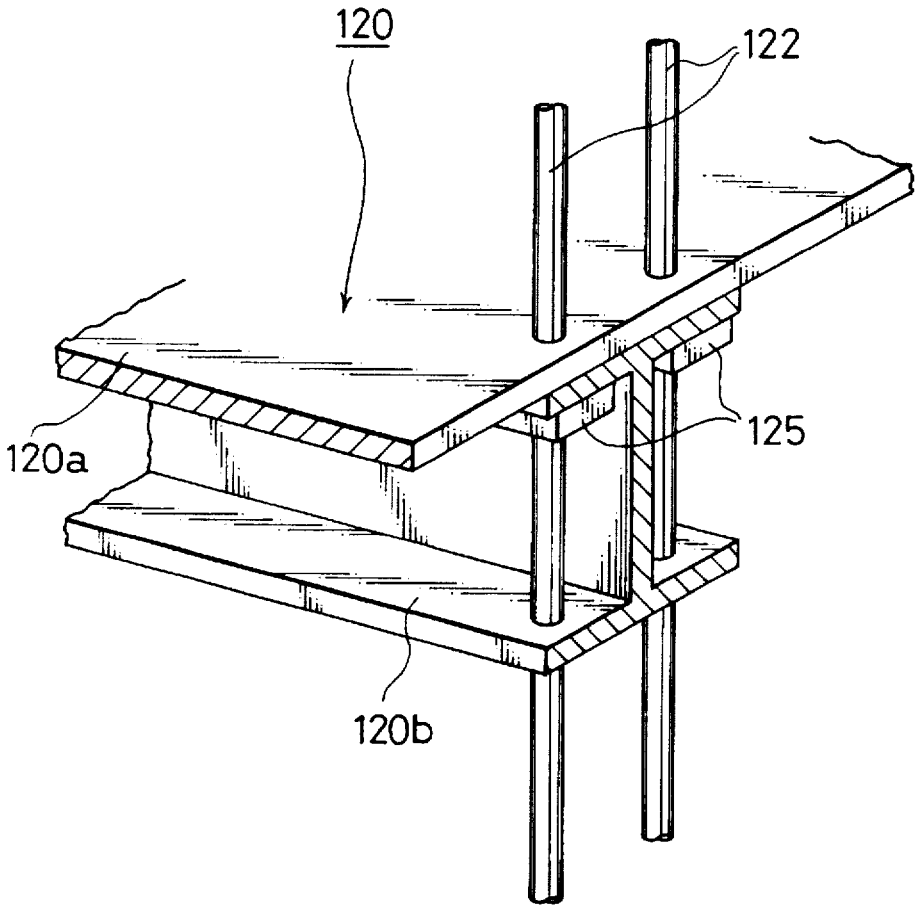
FIG. 29 is a perspective view showing a main part of the underground construction of floor suspension type in accordance with the present invention.

An embodiment of the underground construction of floor suspension type according to a second aspect of the present invention will be described with reference to FIGS. 27 and 28.

The underground construction 110 of floor suspension type generally comprises: a circumference wall 112 forming therein a space of cone shape; outside frame 114 of hexagon ring being horizontally disposed on a top of the circumference wall 112 defining the cone shaped space; support stakes 116 supporting the outside frame 114; supporting beams 118 bridging over the cone shaped space, one ends 118*b* of the supporting beams 118 being supported by the outside frame 114 and the other ends 118*a* being fixedly connected to each other at the center of the cone shaped space; a floor construction body 120 having a floor portion disposed in the middle of the cone shaped space with a fixed interval from the circumference wall 112; plural suspending means 122 hanging the floor construction body 120 in the cone shaped space; each of the suspending means 122 being suspended from a supporting beam 118.

The support stakes 116 have lower ends which extend into the rock board support supporting the outer frame 114 horizontally on the circumference wall 112. The shape of the outside frame may be a circular ring or other polygonal ring. The reference GL represents the ground. In the illustrated embodiment, the floor suspension type underground construction 110 has a 4-floor organization, however, it is not limited thereto. The underground construction may have any number of floors.

The height of each of the floors may be the same or different from each other. The plural support beams 118 are made of steel the cross section of which are "I" shaped. The center side ends 118*a* of the support beams 118 are fixedly connected to each other by welding at the center position of the cone shaped space.

The support beams extend radially from the center side ends 118*a*. The anti-earthquake cushions 124 are disposed between the free ends 118*b* of the support beams 118 and the outside frame 114. With this anti-earthquake cushions 124, the plural support beams 118 and the floor construction body 120 suspended thereby are protected from shaking of earthquake.

The usual ceiling plates may be provided above the upper surface of the support beams 118. The floor construction bodies 120 have configurations similar to that of the outside frame 114 and are disposed at the center of the cone shaped space in a stratum fashion. In the illustrated embodiment, the floor construction body 120 is constituted by the floor body 120*a* and the I-shape steel beams 120*b*.

These floor construction bodies 120 are suspended by plural steel wires 122 in a 4-floor organization. The steel wires 122 hanging the lower floor body 120*a* passes through the upper floor body 120*a* and the I-shape steel beams 120*b*, and support the upper floor bodies 120*a* thereat by the fixing members 125. As described above, when the floor construction bodies 120 are supported both at the center position and the peripheral positions by the steel wires 122 in good balance, the stiffness of the floor construction body 120 against the horizontal bending load is greatly improved. The size of the I-shape steel beams 120*b* can be small thereby cost for the materials can be reduced.

Figure 30:
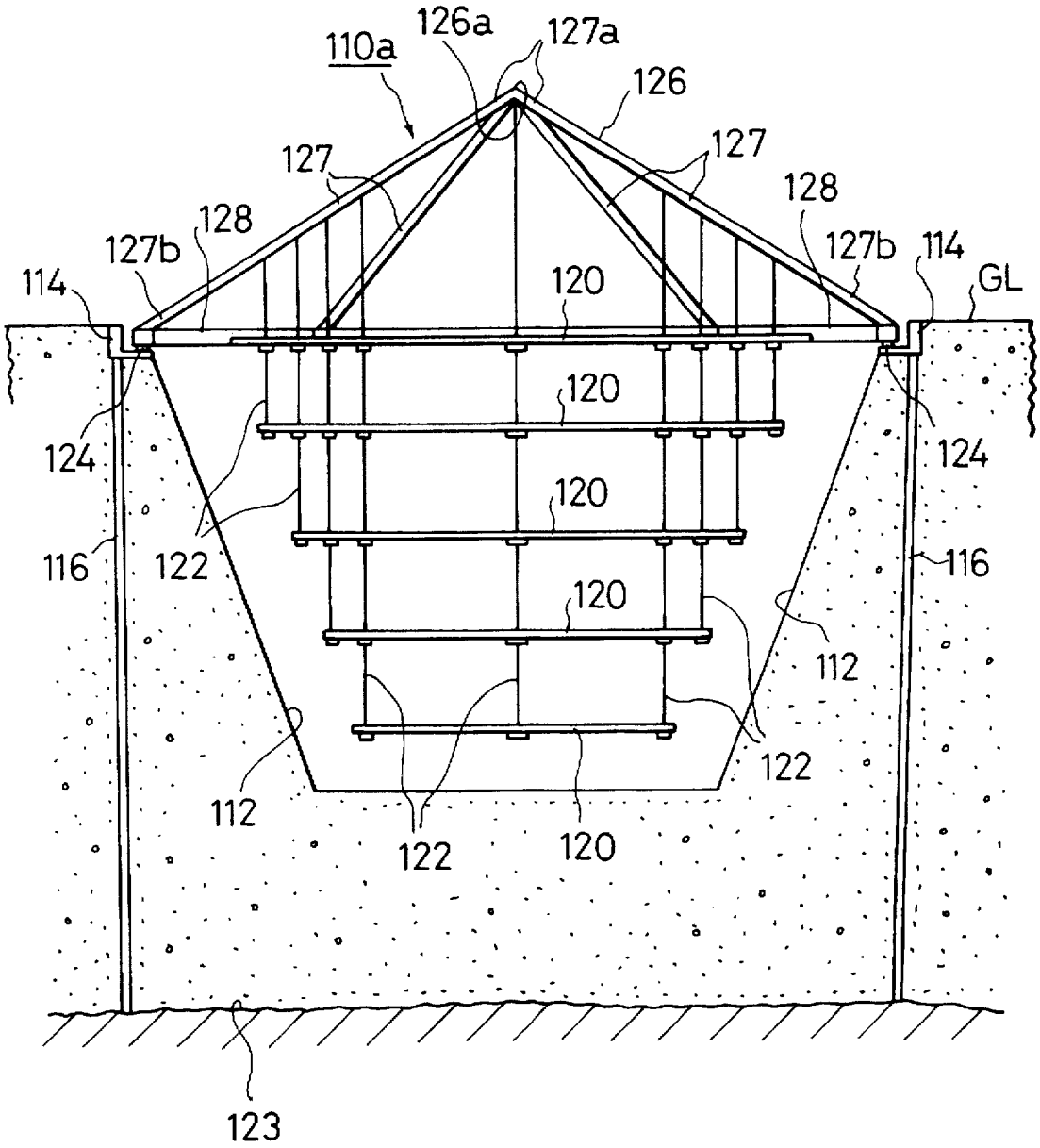
FIG. 30 is a vertical section view showing another embodiment of the underground construction of floor suspension type in accordance with the present invention.

FIG. 30 is a vertical section view of another embodiment of the floor suspension type underground construction in accordance with the present invention.

The underground construction 110*a* of floor suspension type generally comprises: a circumference wall 112 forming therein a space of cone shape; outside frame 114 of square ring being horizontally disposed on top of the circumference wall 112 defining the cone shaped space; support stakes 116 the lower ends of which extend into the rock board support supporting the outer frame 114 horizontally on the circumference wall 112; four supporting beams 127 and four base beams 128 forming a pyramid shape framework 126; floor construction bodies 120 disposed in the middle of the cone shaped space with a fixed interval from the circumference wall 112; and plural steel wires 122 which are suspended by the pyramid shape framework 126 hanging the floor construction body 120 in the middle of the cone shaped space.

The supporting beams 127 and base beams 128 are of I-shape steel members and the pyramid shape framework 126*a* is constituted by these members. Firstly, four base beams 128 are connected to each other so that the bottom square is formed. The lower ends 127*b* of the supporting beams 127 are fixedly connected to the base beams 128 by welding.

Then, the upper ends 127*a* of the inclined supporting beams 127 are connected to each other by welding at the center position of the cone shaped space so that the top 126*a* of the pyramid is formed. The anti-earthquake cushions 124 are disposed between the pyramid shape framework 126 and the outside frame 114.

With the anti-earthquake cushions 124, the floor construction body 120 is protected from the shaking of earthquake. From the view point of structural strength, the pyramid shape framework 126 is very strong against the downward load because it has four inclined triangles abutting to each other. Comparing it to the horizontal support beams 118, the supporting beams 127 can be of small scale. Of course, the shape of the outside frame 114 may be another polygon and the framework 126 may be a polygonal pyramid.

Figure 31:
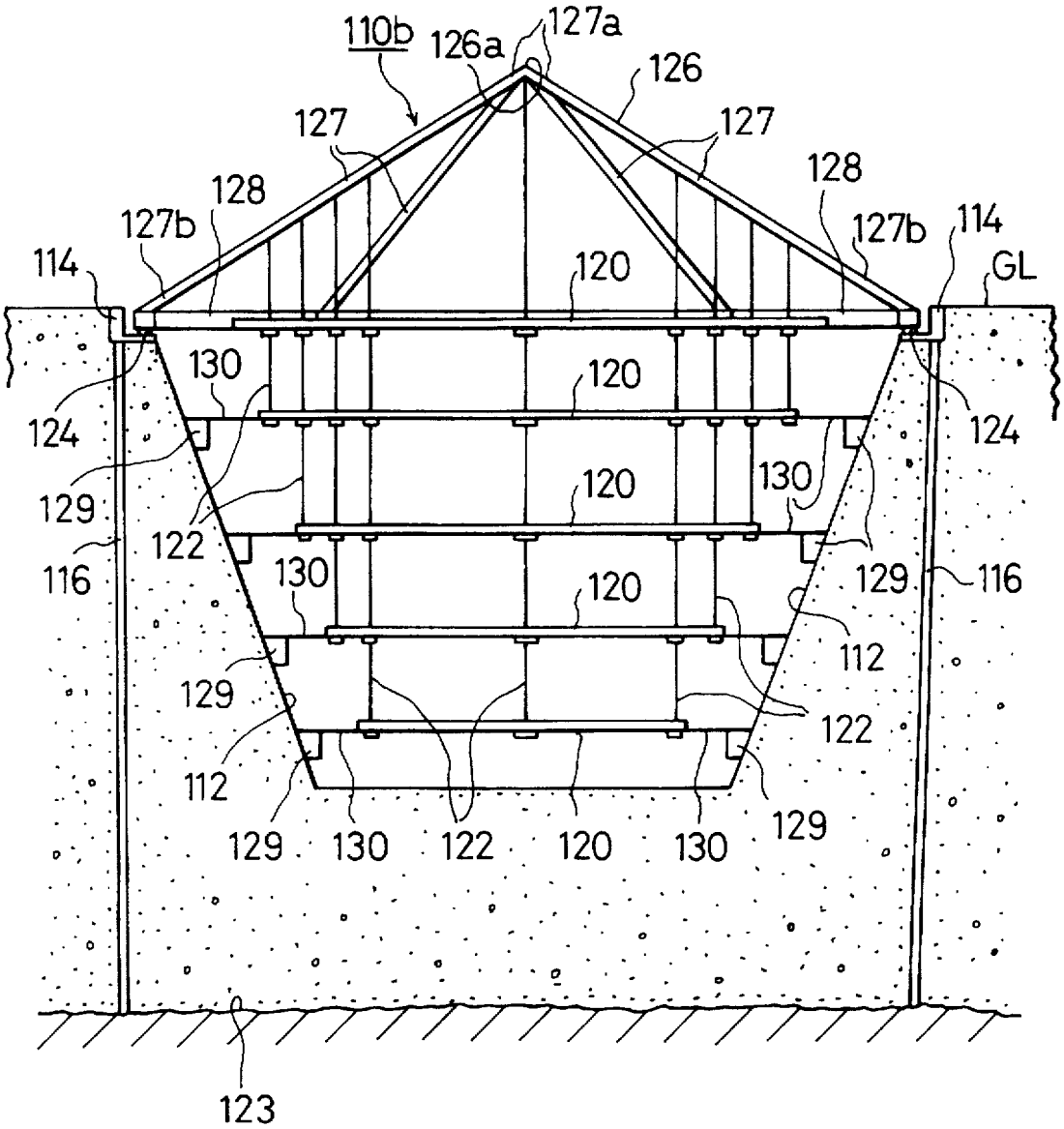
FIG. 31 is a vertical section view showing another embodiment of the underground construction of floor suspension type in accordance with the present invention.

FIG. 31 is a vertical section view of another embodiment of the floor suspension type underground construction in accordance with the present invention. In this embodiment, the floor construction body 120 of the floor suspension type underground construction 110*b* includes plural bed beams 130 the ends of which are supported by plural support members 129. These support members are divided into several groups and the support members 129 of each group are disposed at the same height of the circumference wall 112. The vertical height of each group is different from each other.

The features of this embodiment reside in the point that the support members 129 and plural bed beams 130 are additionally provided. Since each floor construction body 120 is supported both at the center positions and peripheral positions by the support members 127 and the steel wires 122, the stiffness thereof against the horizontal bending load is greatly increased.

Having described the present invention by way of embodiments, it is to be understood that the present invention is not limited to only these embodiments and that various changes and modifications may be made in the invention without departing from the spirit and scope thereof.

What is claimed is:

1. An underground construction formed below the surface of the ground comprising:

a circumference wall extending at an inclined angle from the surface of the ground to a given depth below the surface of the ground so as to define a generally cone-shaped space therein;

a plurality of support members divided into groups, wherein each group consists of several support members which are embedded in said circumference wall at the same vertical height and are spaced circumferentially therearound for supporting bed beams for a floor of the underground construction thereon; and a plurality of floor construction bodies each corresponding to a respective group of support members, each floor construction body including a number of bed beams in spaced arrangement with each other and a floor portion supported by the bed beams, wherein respective ends of the bed beams of each floor construction body extend to and are supported on the corresponding group of support members, and wherein the floor portion of each floor construction body defines a floor space in tapering arrangement in the cone-shaped space in relation to the other floors.

2. The underground construction of claim 1, wherein said floor construction bodies comprise at least 2 floors and an elevator is provided at a center of the cone shaped space.

3. The underground construction of claim 1, wherein an anti-earthquake cushion is provided between each of the several support members and each of the bed beams of the floor construction body.

4. The underground construction of claim 1, wherein the several support members of each group are integrally fixed to an outside frame of a circular ring or polygonal ring, and the outside frame is horizontally disposed on top of the circumference wall.

5. The underground construction of claim 4, wherein the outside frame is supported by support stake foundations extending into a rock board thereby the outside frame being supported at the circumference wall at vertically the same height.

6. The underground construction of claim 1, wherein stairs are provided in a top-bottom direction along the circumference wall, the stairs connecting the ground and each floor portion of each floor construction body, respectively.

7. The underground construction of claim 6, wherein at least two stairs are equally provided in a circumference direction, these stairs being used as stairs for an emergency.

8. The underground construction of claim 1, wherein air-conditioning facilities are provided having small cascades and several thermostats, said small cascades being established at several places on the circumference wall, each of the thermostats being provided corresponding to each of the small cascades, thereby when the thermostat detects a temperature over a predetermined limit temperature, water streams in the small cascade and air-conditioning is carried out by vaporization heat of this cascade.

9. The underground construction of claim 1, wherein air-conditioning facilities are provided having a generator, first ducts and second ducts, the first duct blowing air cooled by the generator from an upper peripheral position of each floor to the center thereof, the second duct sucking air blown out of the first duct at a lower center position of the floor and returning the air back to the generator, the first ducts being provided for each floor independently.

10. The underground construction of claim 1, wherein air-conditioning facilities are provided having a generator, a first duct, a second duct and third ducts, the first duct blowing air cooled by the generator from an upper peripheral position of a highest floor to a center thereof, the third duct sucking air blown out of the first duct at a lower center position of each floor and blowing the air from the upper peripheral position of the each floor to the center thereof, the second duct sucking air blown out of the third duct at the lower center position of a lowest floor and returning the air back to the generator.

11. The underground construction of claim 1, wherein air-conditioning facilities are provided having a generator, fourth ducts, collecting mouths and connecting ducts, the fourth duct directing air warmed by the generator to a lowest floor, the collecting mouth located at a center position of each floor construction body collecting the warmed air, the connecting duct directing the warmed air collected by the collecting mouth to the floor construction body directly thereabove and spreading the air over the floor construction body evenly.

12. The underground construction of claim 1, wherein floors of closed type and floors of open type are provided, the floors of closed type having closed space isolated from outer fresh air, the closed space being defined by floor portions of vertically adjacent paired floor construction bodies and partitions fitted therebetween such as glass plates, outer wall plates etc., the floors of open type having open space through which outer fresh air can pass freely, at least one floor of open type being interposed between at least one pair of floors of closed types thereby noise can be intercepted at a floor interval.

13. The underground construction of claim 12, wherein the floor of open type provides area for a garden, a park, or a field.

14. The underground construction of claim 12, wherein each floor of closed type has a closed space isolated from outer fresh air, the closed space is defined by the floor portions of the vertically adjacent paired floor construction bodies, and partitions are fitted therebetween such as glass plates, outer wall plates, and ceiling plates.

15. The underground construction of claim 12, wherein the support members supporting the bed beams of the floor construction body are offset from each other in the circumference direction between the vertically adjacent paired floor construction bodies.

16. The underground construction of claim 1, wherein a water tank is disposed at a bottom position of the cone shaped space.

17. The underground construction having a water tank of claim 16, wherein small cascades are disposed on several places of the circumference wall, several temperature sensors are provided in correspondence to each small cascade, pipeworks supply the water saved in the water tank to the small cascades which are disposed at several places, and when a temperature sensor detects a temperature over a predetermined temperature, water streams in the small cascades thereby cooling near the circumference wall by vaporization heat of water and the water is returned to the water tank thereby the temperature of water saved therein is lowered.

18. The underground construction having a water tank of claim 16, wherein at least one drain hole is formed in an inclination fashion, the drain hole extending from the circumference wall to the underground, and when the water level of the water tank exceeds over the safety level, the water is thrown away in the underground through the drain hole.

19. The underground construction of claim 1, wherein car move in/out means through which cars can move in or out of each floor construction body are provided for parking lots therein.

20. The underground construction for parking lots of claim 19, wherein the car move in/out means comprises a car elevator piercing through the plural floor construction bodies in a vertical direction.

21. The underground construction for parking lots of claim 19, wherein the car move in/out means comprises a tunnel and plural connection passages, and each connection passage diverges from the tunnel and is connected to each floor construction body in a horizontal direction.

22. The underground construction for parking lots of claim 19, wherein the car move in/out means comprises a spiral lap passage and plural connection passages, and each connection passage diverges from the spiral lap passage and is connected to each floor construction body in a horizontal direction.

23. The underground construction for parking lots of claim 19, wherein the floor portion of the floor construction body slopes downward slightly in a radial direction; at least one exhaust duct extends from a bottom of the underground construction to the ground; at least one gas sensor for detecting concentration of gas is disposed at an appropriate position, and when the gas sensor detects a concentration over a permissible limit, exhausted gas collected at the bottom of the underground construction is exhausted forcedly through the exhaust duct.

24. The underground construction of claim 1, wherein a ceiling construction body having beams and ceiling panels is provided, wherein ends of the beams are supported by the several support members of a highest group, the ceiling panels are supported by the beams and cover over the cone shaped space, the ceiling panel is made of transparent materials and is at the same level as the ground, and the floor construction body provides an area for cultivating plants.

25. The underground construction of claim 24, further comprising a water tank and pipeworks, the water tank being disposed at the bottom of the cone shaped space, and the pipeworks supplying water stored in the water tank to the plants cultivating area in a cycle fashion.

26. The underground construction of claim 24, further comprising light reflection means provided on the circumference wall.

27. The underground construction of claim 1, further comprising cover members which isolate the underground space from outer fresh air, the cover members being detachably installed on a space above a highest floor construction body.

28. An underground construction of floor suspension type formed below the surface of the ground comprising:

a circumference wall extending at an inclined angle from the surface of the ground to a given depth below the surface of the ground so as to define a generally cone-shaped space therein;

an outer frame in the form of a ring horizontally disposed on top of an outer part of the circumference wall at the surface of the ground, and supporting beams having ends supported on said outer frame and bridging over the cone-shaped space defined by said circumference wall;

a plurality of floor construction bodies disposed at respective vertical levels in the cone-shaped space below the surface of the ground, wherein each floor construction body includes a floor portion extending horizontally from said circumference wall at a respective vertical level so as to define an open floor space in tapering arrangement in the cone-shaped space in relation to the other floors; and a plurality of suspending means each being coupled between the supporting beams supported on said outer frame and a respective one of the floor construction bodies at a respective vertical level for hanging each said floor construction body in the cone-shaped space.

29. An underground construction of floor suspension type of claim 28, further comprising a plurality of support members divided into groups, wherein each group consists of several support members which are located at a circumference of the cone-shaped space, and a plurality of floor construction bodies each corresponding to a respective group of support members, each floor construction body including a number of bed beams in spaced arrangement with each other and a floor portion supported by the bed beams, wherein respective ends of the bed beams of each floor construction body extend to and are supported on the corresponding group of support members.

30. The underground construction of floor suspension type of claim 28, further comprising plural base beams fixed to form a polygon which is supported on the outside frame, one ends of each of the plural supporting beams being secured to predetermined positions of the base beams, the plural supporting beams extending in an inclination fashion toward a center point above the cone shaped space, and the other ends of the plural supporting beams being fixed to each other at a center point above the cone shaped space.

31. The underground construction of floor suspension type of claim 28, further comprising anti-earthquake cushions provided between each of the outside frame and the supporting beams.

32. The underground construction of floor suspension type of claim 28, wherein the outside frame is supported by support stake foundations extending into a rock board such that the outside frame is horizontally supported on top of the circumference wall.

33. The underground construction of floor suspension type of claim 28, wherein the floor construction bodies provide plural floors; and the suspending means hanging each lower floor construction body passes through each upper floor construction body and thereby supports said construction body.

* * * * *